US006040104A

United States Patent [19]

Nakamura et al.

[11] Patent Number: 6,040,104

[45] Date of Patent: Mar. 21, 2000

[54] ELECTROPHOTOGRAPHIC TONER, ELECTROPHOTOGRAPHIC DEVELOPER, AND IMAGE FORMING METHOD

[75] Inventors: Masaki Nakamura; Satoshi Yoshida, both of Minami-Ashigara, Japan

[73] Assignee: Fuji Xerox Co., Ltd., Tokyo, Japan

[21] Appl. No.: 09/184,978

[22] Filed: Nov. 3, 1998

[30] Foreign Application Priority Data

Nov. 6, 1997 [JP] Japan ..... 9-304224
Oct. 19, 1998 [JP] Japan ..... 10-297366

[51] Int. Cl.[7] ..... G06G 9/097; G06G 9/087

[52] U.S. Cl. ..... 430/110; 430/111; 430/124

[58] Field of Search ..... 430/110, 111, 430/124

[56] References Cited

U.S. PATENT DOCUMENTS

| | | | |
|---|---|---|---|
| 5,256,507 | 10/1993 | Aslam et al. | 430/111 |
| 5,258,256 | 11/1993 | Aslam et al. | 430/111 |
| 5,637,433 | 6/1997 | Uchida et al. | 430/110 |
| 5,707,771 | 1/1998 | Matsunaga | 430/110 |

FOREIGN PATENT DOCUMENTS

| | | |
|---|---|---|
| 56-158340 | 12/1981 | Japan . |
| 63-25664 | 2/1988 | Japan . |
| 5-61239 | 3/1993 | Japan . |
| 6-19204 | 1/1994 | Japan . |
| 7-92736 | 4/1995 | Japan . |
| 7-159178 | 6/1995 | Japan . |
| 2595239 | 1/1997 | Japan . |

*Primary Examiner*—Roland Martin
*Attorney, Agent, or Firm*—Oliff & Berridge, PLC

[57] ABSTRACT

An electrophotographic toner containing a binding resin and a coloring agent, wherein as the binding resin, a resin is included in which the minimum value of tan δ of the binding resin exists between the glass transition temperature (Tg) and a temperature at which the loss modulus (G") is $1\times10^4$ Pa, the minimum value of tan δ is less than 1.2, the storage modulus (G') at a temperature wherein tan δ is minimum is $5\times10^5$ Pa or more, and the value of tan δ is 3.0 or more at a temperature wherein $G''=1\times10^4$ Pa. Further, a vinyl-based resin can be added in a small amount to the polyester resin having these features to provide a mixture to be used. Further, image formation is conducted using a transfer material in which the same resin is also used in an image-receiving layer. By this, an electrophotographic toner which has the same oil-less fixing property as that for monochrome tone fixing, can conduct fixing without using a releasing agent or using a releasing agent coated at an extremely small amount, provide high image quality and high color developing properties, and has high reliability, and an image forming method using the toner are provided.

20 Claims, 4 Drawing Sheets

ELECTROPHOTOGRAPHIC TONER, ELECTROPHOTOGRAPHIC DEVELOPER, AND IMAGE FORMING METHOD

BACKGROUND OF THE INVENTION

1. Field of the Invention

The present invention relates to an electrophotographic toner which is used in apparatuses utilizing an electrophotographic process such as a copying machine, printer, facsimile and the like, especially in a color copying machine (hereinafter, this toner is sometimes simply abbreviated to "toner"), a process for producing an electrophotographic toner, an electrophotographic developer (hereinafter, this developer is sometimes simply abbreviated to "developer") and a method for forming an image.

2. Description of the Related Art

In an electrophotographic process, a fixed image is formed through a plurality of processes in which a latent image is electrically formed by various means on a photosensitive material utilizing a photoconductive substance, this latent image is developed using a toner, the toner latent image on the photosensitive material is transferred onto a transfer material such as paper and the like to manifest a toner image via or not via an intermediate transfer material, then, this transferred image is fixed on the transfer material such as paper and the like. Recently, owing to the development of apparatuses and the spread of communication networks in today's information-oriented society, electrophotographic processes are used not only in copying machines but also in printers widely, and there are increasingly strict requirements for compactness, lightness and high speed and high reliability of the apparatuses utilized.

Particularly, in the case of color electrophotography, it is required that an image formed has high quality and high color developing ability. For obtaining an image having high quality and high color developing ability, the toner has to be melted sufficiently and the surface of an image after fixation should be smooth in light transmittance, gloss and the like. For this reason, the fixation step in an electrophotographic process becomes very important.

As a contact type fixation method normally used as a fixation method, a method utilizing heat and pressure in fixing (hereinafter, referred to as "heat pressuring method") is general. In this heat and pressure method, since the surface of a fixing member and a toner image on a transfer material are in contact under pressure, heat efficiency is extremely excellent and quick fixation can be conducted, and in particular, this method is very effective in high speed electrophotographic copying machines.

However, in the above-described heat pressuring method, since the surface of a fixing member and a toner image are in contact under pressure in a heat-melted condition, there is a fear of an offset or winding phenomenon in which a part of the toner image is adhered to the surface of the above-described fixing member. In particular, in color toner fixation, since a toner should be fluidized more significantly by application of sufficient heat and pressure as compared with a monochrome toner fixation due to the necessity of melt-mixing of a plurality of toners having different colors, and further, since it is necessary to release thick toner layers composed of a plurality of toners having different colors without offset or winding phenomenon, releasing in color toner fixation is more difficult than releasing in monochrome toner fixation.

As a simple method for preventing adhesion of a toner to the surface of a fixing member, there is conducted a method in which silicone oil and the like as a liquid for preventing offset is coated on the surface of the fixing member. However, in the case of application of the oil and the like, adhesion of the oil to the transfer material and an image after fixation is problematical, further, there are problems that the fixation apparatus needs a tank which stores the oil and the like, accordingly, a reduction in the size of the apparatus is difficult, and replenishment of oil is complicated and restricts cost reduction, and the like.

Conventionally, the amount coated of the above-described oil and the like onto a general transfer material in color fixation is as large as about $8.0\times10^{-2}$ mg/cm$^2$, while in a monochrome printer, oil is not used at all, or if used, the amount coated of oil is $8.0\times10^{-4}$ mg/cm$^2$ or less which is one-hundredth of the amount coated of oil for color fixation, and the above-described defect is not problematical practically. Therefore, also in color fixation, is it eagerly desired that fixation is possible with the same amount of oil coated as for monochrome fixation. For this reason, there have been suggested various methods for enhancing the releasing property of a toner irrespective of fixing apparatuses by improvement of resins, wax and the like used for a toner.

For example, Japanese Patent Application Laid-Open (JP-A) No. 56-158340 and the like disclose monochrome toners which manifest an excellent oil-less fixing property by the effects of wax and a resin containing lower molecular weight components and higher molecular weight components and having a wide-spread molecular weight distribution. These monochrome toner resins are so designed that they can withstand the releasing force applied to a toner layer existing on the surface of a fixing apparatus, owing to rubber elasticity generated by the entangling of higher molecular weight components diluted by lower molecular weight components, namely offset is prevented.

However, for applying this technology to fixation of a color image, there are several problems. Namely, (1) by using as a binding resin one having rubber elasticity due to the entangling of higher molecular weight components, the gloss of the fixed image is reduced, and the color developing ability of a color image decreases, (2) a resin itself is flexible and easily deformed since it contains lower molecular weight components in the molecule even if the binding resin is elastic, therefore, when a toner layer is composed of 3 to 4 layers and the total thickness increases as in a color image, the toner layer easily winds around a fixing apparatus in being released to be deformed, and releasing property decreases, (3) in the case of a color image wherein a toner layer is composed of a plurality of layers, wax bleeds out also between toner layers having different hues, therefore, releasing between the toner layers, namely, offset easily occurs, and an offset preventing effect is not so easily obtained as in the fixation of a monochrome image, and the like.

Also regarding a color toner, although various fixation means containing higher molecular components and fixation means containing wax have been suggested, it is difficult to overcome the above-described problems, and though slight improvement in releasing property is obtained, there has been obtained no improvement at the level where no practical problems exist using the same oil coating amount as that for monochrome toner fixation, up to now.

Japanese Patent No. 2595239 discloses, as a toner used in a fixing apparatus using a fixing heating member constituted of a fluorine resin, a toner characterized regarding the viscoelasticity thereof in that when G' (dynamic storage modulus) is 17000 Pa, G" (dynamic loss elasticity) is from 17000 to 30000 Pa. This indicates an intermediate viscoelastic property between a conventional color toner mainly composed of lower molecular weight resins showing approximately viscous behavior and a monochrome toner showing rubber elasticity due to higher molecular weight components in a sufficiently melted condition of the toner at about 100 to 1000 Pa.s in terms of viscosity. Herein, polyester resins having wide molecular weight distribution, and styrene-acrylic resins having a Mw/Mn of as narrow as 3 or lower and a Mn of about 15000 or more are disclosed, as resins meeting the above-described viscoelastic conditions.

Therefore, if winding of a transfer material onto a fixing apparatus due to adhesion of a toner can be prevented, hot offset resistance is obtained with relatively suppressing color development by this viscoelastic property. However, in a resin of which molecular weight distribution is enlarged by simply combining higher molecular weight components with lower molecular weight components, a sufficient releasing property can not be obtained as described above, therefore, a large amount of oil to be coated is required to prevent winding. Further, the styrene-acrylic resins easily wind on a fixing apparatus and sufficient releasing ability is not obtained since modulus of rubber elasticity is low due to the resin composition even if the molecular weight thereof is increased.

Regarding addition of wax, when wax is added to a toner, releasing property tends to increase, however, there is a problem that light transmittance, charging property, toner powder flowability and the like tend to deteriorate. Particularly, in a toner obtained by a pulverizing method in which wax is exposed on the surface, deterioration of charging property and toner powder flowability tend to be remarkable. JP-A Nos. 5-61239, 7-92736, 7-159178 and the like disclose polymerization toners mainly composed of styrene-acrylic resins in which exposure of wax on the surface is suppressed by using suspension polymerization methods. Since these can prevent a reduction of surface properties and conditions caused by wax, flowability and releasing property of a toner powder are improved. However, since a styrene-acrylic resin is a main component, there is a tendency that winding easily occurs as described above, and this tendency becomes remarkable in the case of a color image wherein toners of various colors are laminated and the total toner layer thickness increases, and stable releasing is difficult.

In general, in conventional color fixation, a short life of a fixing roll due to reduction in the releasing property is pointed out as a significant problem.

As described above, it is difficult using conventional technologies to accomplish the oil-less fixing property of a toner attained now in a monochrome copying machine, in a color copying machine in which a higher image quality is required, and currently a new toner is required which is excellent in releasing property and can provide a color image having high quality.

SUMMARY OF THE INVENTION

An object of the present invention is to provide an electrophotographic toner which solves the above-described conventional problems and is suitable also as a color toner, and a method for forming an image using the same.

Namely, the first object of the present invention is to provide an electrophotographic toner which has the same oil-less fixing property as that for monochrome toner fixation, can be fixed without using a releasing agent or by coating an extremely small amount of a releasing agent, manifests high image quality and high color developing property, and has excellent reliability.

The second object of the present invention is to provide an electrophotographic developer which is obtained by using the above-described electrophotographic toner, has an excellent fixing property and manifests a high image quality and a high color developing property. Further, the third object of the present invention is to provide a method for forming an image which can form an image which manifests a high image quality and a high color developing property and also has excellent gloss, using the above-described developer.

Conventionally, as a method for producing a toner, there is often used a kneading pulverizing method which is one of the dry production methods. The kneading pulverizing method is a method in which a coloring agent such as a pigment or a dye, and optionally a releasing agent and a charge controlling agent are melted and kneaded into a binding resin represented by a thermoplastic resin, then pulverized, and further classified to obtain a toner having the desired particle size. This method is very excellent in that the dispersibility of the coloring agent and other additives in the binding resin can be enhanced, and the type of the binding resin is not restricted, and is currently most generally used.

However, the electrophotographic toner of the present invention may not easily be ground by a kneading pulverizing method. Therefore, there are sometimes problems that the pulverizing efficiency of a toner is lowered since size reduction of the toner is conducted in response to the requirements of a high image quality, and a size reduction to the desired size has not been possible.

Accordingly, the fourth object of the present invention is to provide an electrophotographic toner and an image forming method which solve the above-described problems. Namely, the fourth object of the present invention is to provide an electrophotographic toner which has the same oil-less fixing property as that for monochrome toner fixing, can be fixed without using a releasing agent or by coating an extremely small amount of a releasing agent, manifests high image quality and high color developing property, has excellent reliability, and further has high productivity.

Conventionally, for presentation and the like, an image is formed on a transparent film by an electrophotographic method, the transparent film carrying a toner image is placed on an over head projector (hereinafter, abbreviated as "OHP"), and a projected image is obtained. However, when a color image is simply formed on a base material such as polyethylene terephthalate (hereinafter, abbreviated as "PET") and the like, the color developing property is sometimes not obtained in the projected image, particularly a neutral tone image, and the image becomes turbid. This occurs because in fixing, a toner fixation part rises in the form of a semi ellipse, and a light incidented from the base material side is scattered on the surface of the toner when emitted from the toner layer. This phenomenon appears remarkably in the range wherein the toner concentration is such that adjacent toners are not bonded by melting, particularly in the neutral tone range, and the projected image is made turbid.

Also when image forming is conducted using the electrophotographic toner of the present invention, the color developing property in the projected image sometimes becomes insufficient depending on the image formed. Therefore, there is required a method for forming a translucent image which maintains offset resistance and has excellent color developing property also in oil-less fixation without sacrificing the properties of the toner itself.

The fifth object of the present invention is to provide an image forming method which uses the electrophotographic toner of the present invention and further, is suitable for forming a translucent image.

The present inventors and the like have noticed a releasing effect due to viscoelasticity in releasing deformation of the whole toner layer which is not restricted by the releasing effect at the interface between the toner and a fixing machine from wax and oil, and as a result of intensive studies have found that the releasing property can be controlled by regulating not the viscoelastic property in the soft elastic modulus range of about $1\times10^4$ which is the range in which the existence of a polymer component which has conventionally been studied is reflected, but by regulating the viscoelastic property at the high elastic modulus of $1\times10^5$ to $1\times10^6$ Pa, thereby completing the present invention.

Namely, the electrophotographic toner of the present invention is an electrophotographic toner containing a binding resin and a coloring agent, wherein as the binding resin, a resin is contained in which the minimum value of tan δ of the binding resin exists between the glass transition temperature (Tg) and a temperature at which the loss modulus (G") is $1\times10^4$ Pa, the minimum value of tan δ is less than 1.2, the storage modulus (G') at a temperature wherein tan δ is minimum is $5\times10^5$ Pa or more, and the value of tan δ is 3 or more at a temperature wherein $G''=1\times10^4$ Pa.

In the fixing process of a toner, releasing of a toner image from a fixing roll involves the task of peeling a polymer chain of a toner binder at the adhesion interface between the toner image and the fixing roll. Since a toner image, in particular, a color toner image is practically composed of a plurality of layers laminated having different colors and has a total thickness of from 10 μm to 20 μm, this peeling work is one which deforms not only the toner at the adhesion interface but the whole toner layer. For easy peeling, three conditions are required to be satisfied, including (1) small energy loss, (2) the energy for releasing deformation is stored before significant deformation of the toner layer, and (3) a particulate toner flows during fixing.

When these conditions are intended to be realized in the viscoelastic property of the toner, it is necessary that the loss modulus is small to decrease energy loss, it is necessary that the storage modulus is large to store the energy for releasing deformation, and it is necessary that tan δ (=loss modulus/storage modulus) is large for the toner to flow.

The toner achieved in the present invention satisfies these three conditions simultaneously. More specifically, the time for passing through a fixing nip is from 30 to 100 msec, while releasing is a phenomenon which occurs in an instant corresponding to 1/10 to 1/100 of this time, and the toner of the present invention satisfies the severe conditions that condition (3) must be fulfilled during the time taken in passing through a fixing nip and that conditions (1) and (2) should be fulfilled during the instant of releasing.

In the present invention, the amount of oil coated on a fixing apparatus of $8.0\times10^{-4}$ mg/cm$^2$ or less is called, hereinafter, the same amount coated of oil as that for monochrome toner fixing or the same amount coated of a releasing agent as that for monochrome toner fixing.

DETAILED DESCRIPTION OF THE INVENTION

Figure 1:
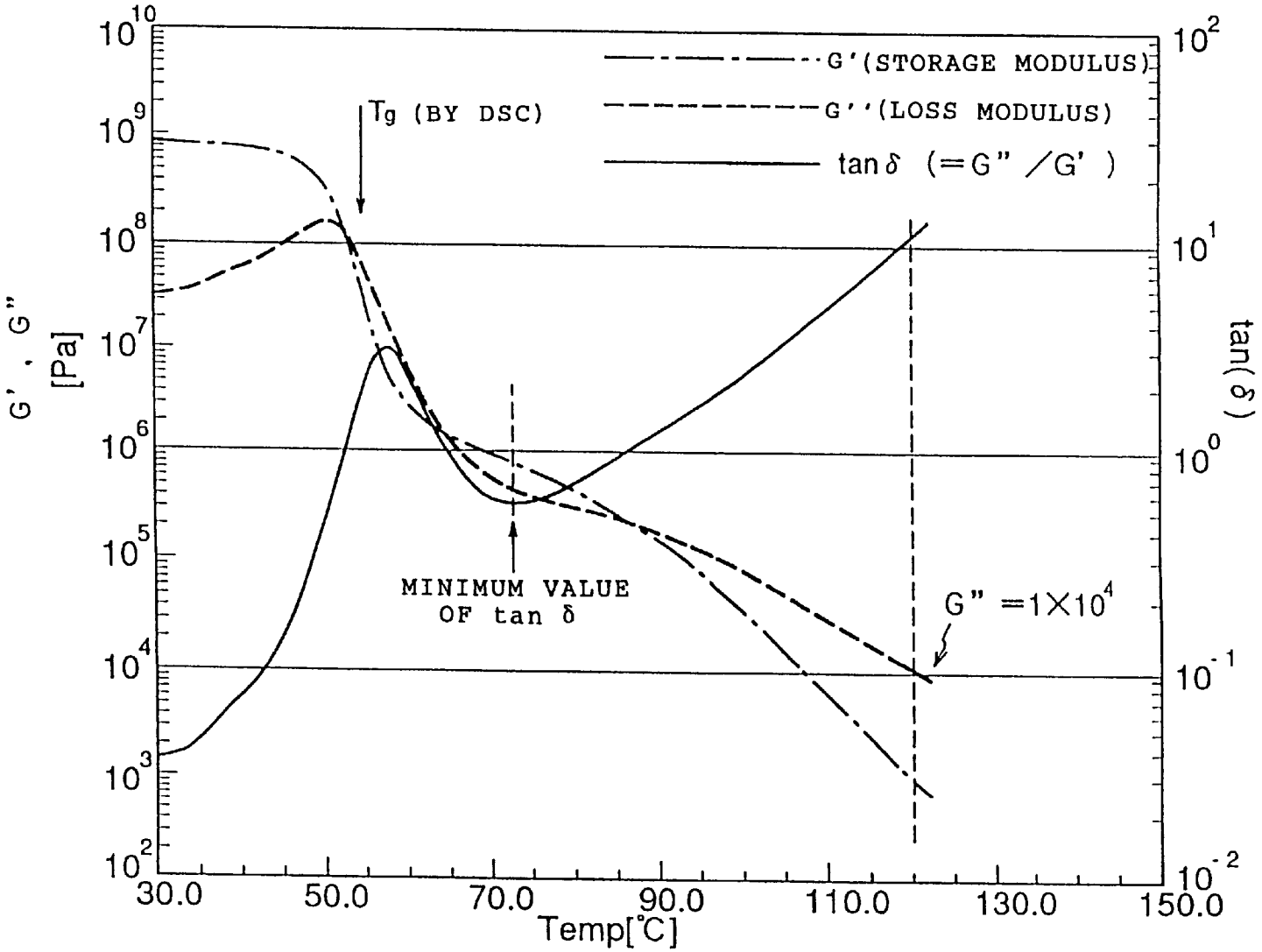
FIG. 1 is view illustrating the viscoelastic property value of a binding resin used in the electrophotographic toner of the present invention.

A view illustrating the viscoelastic property prescribed as the physical property of a binding resin in the present invention is shown in FIG. 1. G' represents storage modulus (in FIG. 1, shown by a single dot chain line graph), G" represents loss modulus (in FIG. 1, shown by a broken line graph), and tan δ (tan Delta: loss tangent, in FIG. 1, shown by a solid line graph) represents G"/G'.

These values are obtained from measurement of the dynamic viscoelasticity. To explain briefly, during deformation, G' is the elastic stress component of the modulus of elasticity in the relation between the deformation and the reaction force which is generated in response to the deformation, and the energy for this deformation task is stored. G" is the viscosity stress component of the above-described modulus of elasticity, and the energy required for this deformation task is lost in the form of heat. Tan δ is (=G'/G") is the ratio thereof and is a measurement of the amounts of energy stored and the energy required for the task of deformation.

The binding resin of the present invention has a viscoelastic property in which the minimum value of tan δ exists between Tg and a temperature at which G" is $1\times10^4$ Pa, the minimum value of tan δ is less than 1.2, G' at a temperature wherein tan δ is at the minimum is $5\times10^5$ Pa or more, and the value of tan δ is 3 or more at a temperature wherein $G''=1\times10^4$ Pa. In other words, this viscoelastic property represents a property where in the middle term during a fixing process, when a binding resin is in a melted form between nips, a high viscous property is manifested, and in releasing in the final step, the binding resin has high elastic modulus, and the elastic property is the same or more than the viscous property.

The viscoelastic property in the present invention is obtained as follows: A parallel plate having a diameter of 8 mm is used in a rotation flat plate type rheometer (manufactured by Rheometoric Scientific F.E. Ltd.: RDA2, RHIOS system ver. 4.3), strain of 20% or less is imparted at a frequency of 1 rad/sec, and the viscoelastic property was measured using about 0.3 g of a sample at a temperature increasing speed of 1° C./min between about 40 to 150° C.

By satisfying the above-described viscoelastic property, the releasing of a toner is excellent and a clear color developing property is obtained even by fixing at the same amount of oil coated as that for monochrome printing. The reason for this is described below.

Usually, the nip time in heat roll fixing is from 20 to 100 sec, and the corresponding measured frequency in viscoelasticity measurement is taken to be about 10 to 100 rad/sec. Since releasing deformation occurs instantly, the measured frequency against releasing deformation is supposed to be higher by one or two digits than the measured frequency against nip time. Since fixing of a toner is known to be conducted at a viscosity of about 1000 Pa.s, the elastic modulus corresponding to releasing deformation is about $1\times10^5$ Pa. Therefore, it is estimated that releasing deformation is influenced by viscoelastic property at a modulus between glass condition up to $1\times10^4$ Pa.

It is believed that in viscoelastic property regarding the above-described releasing deformation, by setting the above-described minimum value of tan δ at less than 1.2, when a polymer chain is deformed, the storage modulus G' becomes the same as or more than the loss modulus G", namely, a condition is obtained wherein the resin is elastic like rubber and energy loss is small, and a condition is obtained wherein force can be transmitted without offset between molecules, from a polymer chain to another polymer chain in a toner layer having sufficient thickness as compared with the molecular size of the polymer, and also to a polymer chain existing in the interface between the toner and the fixing apparatus, and simultaneously, by setting G' in this case to $5\times10^5$ Pa or more, the resin becomes rubber having high elastic modulus, therefore, winding deformation can be prevented and releasing of the toner becomes excellent.

To satisfy these two viscoelastic properties simultaneously is a necessary and sufficient condition for obtaining an effective releasing property in the present invention. When the minimum value of tan δ is 1.2 or more, or G' is less than $5\times10^5$ Pa at a temperature corresponding to the minimum value of tan δ, winding is caused in any case, and sufficient releasing property is not obtained. In obtaining the releasing property, more preferably, G' is not less than $6\times10^5$ Pa, preferably not less than $7\times10^5$ Pa at a temperature corresponding to the minimum value of tan δ, and more preferably, the minimum value of tan δ is 1.0 or less, preferably 0.9 or less.

Further, the binding resin of the present invention is required to have viscoelastic property wherein the value of tan δ at a temperature wherein $G''=1\times10^4$ Pa is 3.0 or more. This is a necessary condition in order for the toner to be in a fluid state while the unfixed toner image is passing through the fixing apparatus thereby leading to the toner image having high gloss and high color development. By satisfying this condition, the resulting toner image becomes a clear color image also as an image projected on an OHP. When this value of tan δ is less than 3, the fixed image becomes matt and color developing becomes insufficient, and also, the OHP projected image has insufficient color developing property.

The binding resin of the present invention has a glass transition temperature (Tg) of preferably in the range from 45° C. to 100° C., more preferably in the range from 50° C. to 75° C., and most preferably in the range from 55° C. to 70° C. When Tg is less than 45° C., the toner is easily blocked by heat, and when Tg is higher than 100° C., the fixing temperature becomes too high.

The glass transition temperature (Tg) of a resin can be measured by a normal method, for example, using a differential scanning calorimeter (manufactured by MAC SCIENCE Co.,Ltd.: DSC3110, heat analysis system 001: hereinafter, abbreviated as "DSC") under conditions of a temperature rising speed of 5° C./minute, and a temperature on the shoulder of the lower temperature side of the heat absorption point corresponding to Tg of the resulting chart can be recognized as Tg. Tg in the present invention is measured as described above.

Further, the temperature at which the binding resin of the present invention has $G''=1\times10^4$ Pa is desirably 150° C. or less. When it is over 150° C., the fixing temperature becomes too high.

Next, the binding resin having the viscoelastic property suitable for the toner of the present invention will be described in detail.

As the binding resin used in the present invention, polyamide resins, polycarbonate resins, polyether resins, polyacrylonitrile resins, polyallylate resins and polyester resins are preferably listed in view of the large value of the storage modulus G' at a temperature wherein tan δ is at a minimum. Among these, in view of the melting temperature range, the glass transition temperature, the ease with which charging ability is controlled, the binding resin of the present invention preferably used is mainly composed of a polyester resin.

When illustrated specifically, for example, in the case of conventionally used styrene-acrylic resins having a narrow molecular weight distribution (Mw/Mn=3) and a higher molecular weight (Mw=100,000), the viscoelastic property at a temperature corresponding to the minimum value of tan δ includes $G'=1.1\times10^5$ Pa and tan δ=0.9. Further, even among the same styrene-acrylic resin compositions, in the case of a resin comprising lower molecular weight components and higher molecular weight components (Mw/Mn=50) and having a higher molecular weight (Mw=200,000), viscoelastic property at a temperature corresponding to the minimum value of tan δ include $G'=1\times10^4$ Pa and tan δ=0.67. Namely, it is known that even if the resin simply contains higher molecular weight components or has a raised average molecular weight, G' at a temperature corresponding to the minimum value of tan δ cannot satisfy the scope of the present invention though the minimum value of tan δ can be reduced. This tendency is observed in styrene-based resins in general having excellent viscosity, and none of them is suitable for the binding resin applied to the toner of the present invention.

For satisfying the viscoelastic property in the present invention, linear polyester resins are preferably used among polyester resins.

Preferable polyester compositions and molecular weight will be described below.

As the composition of polyesters satisfying the above-described viscoelastic property suitable for the binding resin in the toner of the present invention, those which at least tend to increase the storage modulus at a temperature corresponding to the minimum value of tan δ are suitable, and from this viewpoint, as the dicarboxylic acid component, specifically, terephthalic acid, isophthalic acid, cyclohexanedicarboxylic acid; naphthalene dicarboxylic acids such as naphthalene-2,6-dicarboxylic acid, naphthalene-2,7-dicarboxylic acid and the like; and biphenyldicarboxylic acid are preferable, and as diol components, any of ethylene glycol, propylene glycol, neopentyl glycol, cyclohexanedimethanol, ethylene oxide adducts of bisphenol A (compound A) or trimethylene oxide adducts of bisphenol B (compound B) represented by the following formula, or any combination comprising two or more of these as the main component, are preferable.

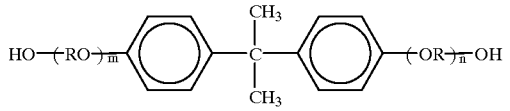

Compound A: R = $CH_2CH_2$
Compound B: R = $CH_2CH_2CH_2$

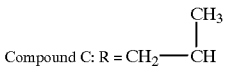

Compound C: R = $CH_2$—CH (wherein, m and n each independently represent an integer from 2 to 7)

For example, a propylene oxide adduct of bisphenol A (compound C) is a diol component conventionally often used in polyester resins for toners, and when this is used, G' at a temperature corresponding to the minimum value of tan δ decreases as compared with the case wherein the above-described preferable diols are used. Likewise, even if orthophthalic acid for general purpose is used, G' at a temperature corresponding to the minimum value of tan δ decreases. Therefore, in the present invention, it is not preferable to use these diols and dicarboxylic acids as main components.

Further, polyester resins for general use having a cross-linked structure in the molecule, known as binding resins for toners tend to give lowered G' at a temperature corresponding to the minimum value of tan δ as compared with linear resins, and are not preferable for the binding resin of the present invention. The reason for this is hypothesized in that a molecular chain having cross-linked structure has small spreading of the chain, and gives weaker effect for transmitting deformation as compared with linear molecular chains.

Therefore, it is also not preferable to use monomers having a trivalent or more cross-linked structure as the main component of the carboxylic acids and diols. However, providing the viscoelastic property of the present invention is satisfied, trivalent or more carboxylic acid and trivalent or more alcohol may be used in an extremely small amount (less than about 2 mol %) for improving other physical properties.

As standards of the molecular weight for obtaining the viscoelastic property of a binding resin suitable in the present invention, the number-average molecular weight Mn is from 6000 to 10000, the weight-average molecular weight Mw is from 15000 to 25000, z-average molecular weight Mz is from 30000 to 70000, Mw/Mn is from 3 to 5. The above-described molecular weights and molecular weight distribution can be measured by known methods, and generally measured by gel permeation chromatography (hereinafter, abbreviated as "GPC"). GPC measurement can be conducted, for example, using HLC-802A manufactured by TOYO SODA as a GPC apparatus, at an oven temperature of 40° C., a column flow rate of 1 ml/min., a sample injection amount of 0.1 ml and a sample concentration of 0.5% using THF for GPC manufactured by Wako Pure Chemical Industries Ltd. The preparation of a calibration curve can be conducted for example using a standard polystyrene sample manufactured by TOYO SODA. The above-described molecular weights and molecular weight distribution in the present invention were measured as described above.

Further, the monomers described below can also be used in addition to the above-described preferable monomers, within the range wherein the viscoelastic property of the present invention is satisfied.

Examples of the divalent carboxylic acid include dibasic acids such as succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid, mesaconic acid and the like, and anhydrous compounds thereof and lower alkyl esters thereof, and aliphatic unsaturated dicarboxylic acids such as maleic acid, fumaric acid, itaconic acid, citraconic acid and the like, as well as other compounds. As the trivalent or more carboxylic acid which can be used together providing the amount thereof is small, for example, 1,2,4-benzenetricarboxylic acid, 1,2,5-benzenetricarboxylic acid, 1,2,4-naphthalene tricarboxylic acid and the like, and anhydrous compounds thereof and lower alkyl esters thereof, are listed. These may be used alone or in combinations of two or more.

Examples of the divalent alcohol include bisphenol A, hydrogenated bisphenol A, ethylene oxide or (and) propylene oxide adduct of bisphenol A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, neopentyl glycol and the like.

As the trivalent or more alcohol which can be used together providing the amount thereof is small, for example, glycerin, trimethylolethane, trimethylolpropane, pentaerythritol and the like are listed. These maybe used alone or in combinations of two or more.

If necessary, for the purpose of controlling acid value and hydroxyl value, monovalent acids such as acetic acid, benzoic acid and the like, and monovalent alcohol such as cyclohexanol, benzyl alcohol and the like can also be used.

The above-described polyester resins can be synthesized by selecting suitable monomers among these monomer components and combining them and using conventionally known methods described in Polycondensation (Kagaku Doujin Publishing Co.,Ltd.), Kobunshi Jikkengaku (polycondensation and polyaddition: Kyoritsu Shuppan Co., Ltd.), POLYESTER RESIN HANDBOOK (Nikkan Kogyo Shinbun, Ltd. ed.) and the like, and specifically, transesterification and direct polycondensation and the like can be used alone or in combination. In particular, for synthesizing linear polyesters of the high degree of polymerization suitable for the present invention, synthesis conditions should be considered such as increasing the purity of the monomer, increasing the degree of vacuum for removing reaction by-products, optimization of reaction temperature, optimization of reaction catalysts, and the like. Further, a polyester resin having a low degree of polymerization can be made into a resin having a high degree of polymerization by using a diisocyanate-containing compound and the like. Among these, there are preferably used linear polyester resins including polyester resins obtained by polymerization using transesterification. The reason for this is that, in the case of direct polycondensation reaction, it becomes extremely difficult to obtain a polyester having a high degree of polymerization because of a reduction in the purity of the monomer and a slight difference from the optimum charging amount of the monomer, however, according to this transesterification method, a linear polyester resin having a uniform molecular weight can be easily obtained.

The transesterification method is a synthesis method in which, at least one volatile monomer under reaction temperature and reduced pressure (near vacuum) for transesterification, for example, a monomer having a boiling point of about 250° C. or less under reduced pressure such as ethylene glycol, neopentyl glycol and the like is used, and as the first step, a transesterification reaction between an acid component and an alcohol component is conducted at a temperature from 150° C. to 280° C., then, as the second step, a transesterification reaction is allowed to be conducted while removing volatile monomers out of the system at a temperature from about 180° C. to 380° C. under reduced pressure to increase the degree of polymerization, and if volatile monomers are used excessively, they can be discharged out of the system in the second step, therefore, no reduction in the molecular weight due to a difference in the monomer ratio of acid to alcohol occurs. Accordingly, this method can synthesize a polyester having a high degree of polymerization easily and in narrow molecular weight distribution, and particularly, the method is effective in synthesizing a linear polyester.

The polyester resin synthesized by this method has a hydroxyl group on the end, and when used as a binding resin in a toner, it is also possible that a part of or all terminal hydroxyl groups are modified with trimellitic anhydride and the like to impart acid value and to control the negative charging amount.

A more preferable binding resin of the present invention contains at least two kinds of resins (A,B) as the above-described binding resin, and in at least one resin (A), Tg is from 45° C. to 65° C., the minimum value of tan δ of the resin exists between Tg and a temperature wherein $G''=1\times10^4$ Pa, the minimum value of tan δ is less than 1.0, and the value of tan δ at a temperature wherein $G''=1\times10^4$ Pa is 1.0 or more, and the Tg used together in the resin (B) exists between Tg+5° C. and Tg+15° C. of the resin (A), and the minimum value of tan δ of this resin exists between Tg and a temperature wherein $G''=1\times10^4$ Pa, and as the whole binding resin, the above-described viscoelastic property is satisfied.

Figure 2:
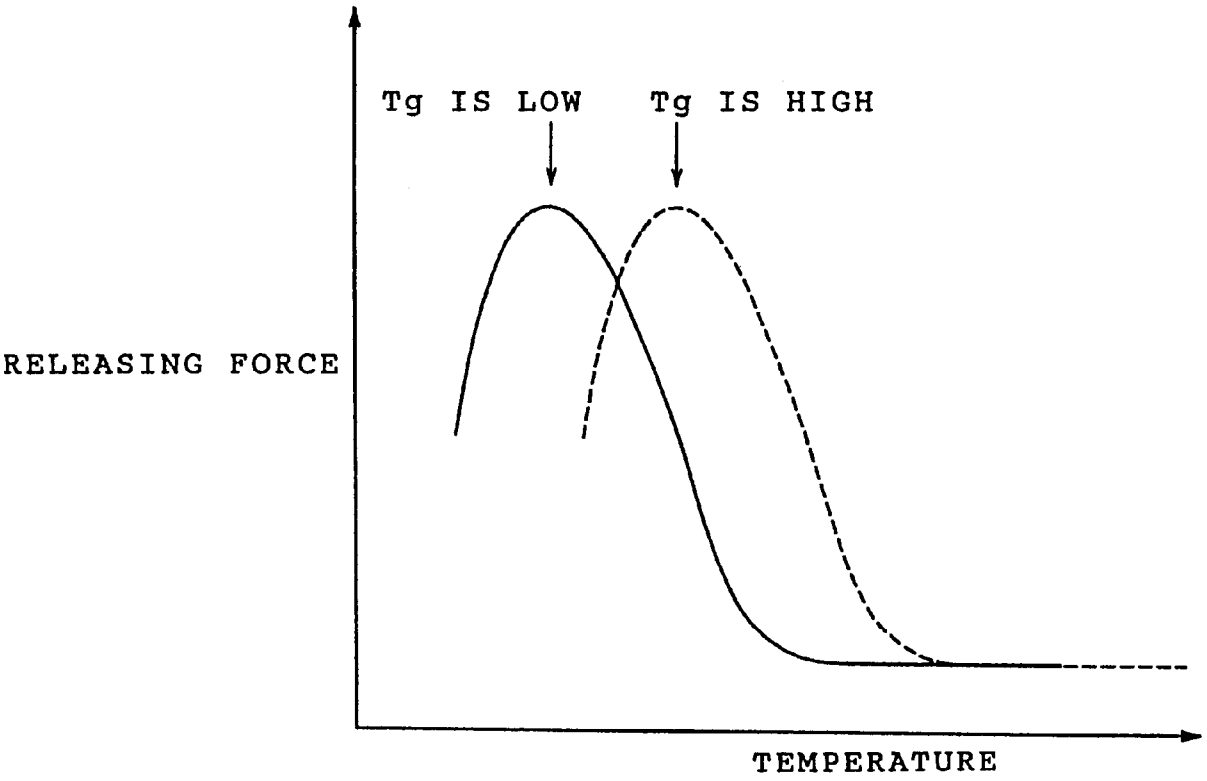
FIG. 2 is a conceptual view showing the temperature dependence of the releasing property of the binding resin used in the electrophotographic toner of the present invention.

To combine two or more resins as described above is preferable since the fixing temperature is set at lower temperature and since heat blocking resistance is improved. As shown in FIG. 2, in a resin satisfying the viscoelastic property of the present invention, temperature dependence of the energy required for releasing has a peak of around Tg, and the energy required for releasing decreases and the resin becomes releasable easily with a rise in temperature. If the releasing property is observed when Tg is allowed to vary by changing the composition in a binding resin having approximately the same molecular weight, the reduction of releasing energy against temperature rising shifts to the higher temperature side (shown by a broken line) more significantly in a resin having a higher Tg as compared with the case for a resin having a lower Tg. Therefore, there is a necessity also to shift the setting of the fixing temperature to the higher temperature side. However, by combining a resin which is a higher molecular weight component having a lower Tg and a resin which is a lower molecular weight component having a higher Tg with changing the resin composition, the effect of the present invention can be obtained without increasing the fixing temperature. Further, regarding a lower molecular weight component, since a lower molecular weight component in a resin acts disadvantageously against blocking resistance, blocking resistance can be improved also by raising the Tg of the lower molecular weight component by changing the composition. Therefore, the degree of freedom of the compounding composition is improved as compared with the case wherein the above-described viscoelastic property is provided by a resin composed of one component, further, if a combination of resins is designed for general use, a toner whose fixing temperature is lower can be easily obtained at low cost.

The compositions and molecular weights of polyester resins used in a blend of the above-described binding resin may advantageously be selected so that desired Tg and viscoelasticity are obtained from the above-described monomer group. In the toner of the present invention having this viscoelastic property, the releasing property of the binding resin itself is excellent, and particularly, it can be used suitably without containing wax in the toner composition. However, for the purpose of enlargement of offset temperature latitude and improvement in the cleaning ability of a non-visual offset toner, the inclusion of a small amount of wax is not precluded. Further, addition of a suitable amount of wax is useful for the efficiency of the fixing process.

As the wax which can be used in the toner of the present invention, for example, there are listed paraffin wax such as a lower molecular weight polypropylene, lower molecular weight polyethylene and the like, silicone resins, rosins, rice wax, carnauba wax and the like, and among them, those having a melting point from 40° C. to 150° C. are preferable, and those having a melting point from 70° C. to 110° C. are more preferable. However, when the content of the wax is too high, there is a fear that the quality of a color image and reliability deteriorate as follows: wax existing on the surface of a color fixed image and in the image deteriorates the projection ability by OHP; when applied to two-component developer, wax in the toner migrates into a carrier by abrasion and the charging ability of the developer varies with the passing of time; when used as a one-component developer, wax migrates into a blade for imparting charge by abrasion between the toner and the blade and the charging ability of the developer varies with the passing of time; flowability of the toner deteriorates; and the like. The content of the wax is preferably from 0.1 to 7%, more preferably from 0.5 to 5%, and further preferably from 0.5 to 4%.

Coloring agents used in the toner of the present invention are not particularly restricted, and coloring agents known per se are listed, and appropriately may be selected according to the object. Examples of the coloring agent include carbon black, Lamp black, aniline blue, Ultramarine blue, Carcoyl blue, methylene blue chloride, copper phthalocyanine, quinoline yellow, chrome yellow, Dupont oil red, Orient oil red, Rose bengal, Marakite green oxalate, Nigrosin dye, C.I. pigment red 48:1, C.I. pigment red 57:1, C.I. pigment red 81:1, C.I. pigment red 122, C.I. pigment yellow 97, C.I. pigment yellow 12, C.I. pigment yellow 17, C.I. pigment blue 15:1, C.I. pigment blue 15:3 and the like.

The content of the above-described coloring agent in an electrophotographic toner is preferably from 1 to 30 parts by weight based on 100 parts by weight of the above-described binding resin, and it is preferable that the coloring agent is contained in an amount as high as possible within the range wherein the smoothness of the surface of an image after fixing is not lost. An increase of the content of the coloring agent is advantageous, since the thickness of an image can be reduced while obtaining an image having the same density, and offset is effectively prevented. According to the type of the above-described coloring agent, a yellow toner, magenta toner, cyan toner, black toner and the like can be produced.

In the toner of the present invention, various known additives can be used together for improvement of properties, providing the effect of the present invention is not lost. The additive is not particularly restricted, and may be appropriately selected according to the object, for example, various additives known per se such as inorganic fine particles, organic fine particles, charge controlling agents, releasing agents and the like are listed.

Examples of the inorganic fine particles include silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, silicon nitride and the like. Among these, silica fine particles are preferable, and particularly, silica fine particles which have been hydrophobizated are preferable. The above-described inorganic fine particles are usually used for the purpose of increasing flowability. The primary particle size of the above-described inorganic fine particles is preferably from 1 to 1000 nm, and the amount added thereof is preferably from 0.01 to 20 parts by weight based on 100 parts by weight of a toner. Examples of the organic fine particles include polystyrene, polymethyl methacrylate, polyvinylidene fluoride and the like. The above-described organic fine particles are usually used for the purposed of improving cleanability and transferring properties. Examples of the charge controlling agent include metal salts of salicylic acid, metal-containing azo compounds, nigrosine, quaternary ammonium salts and the like. The above-described charge controlling agent is usually used for the purpose of improving chargability.

The electrophotographic toner of the present invention can be produced by production methods known per se. The above-described production method is not particularly restricted, and can be appropriately determined according to the object. For example, as toner dry production methods, a kneading pulverizing method and kneading freezing pulverizing method are listed, as toner wet production methods, an in-liquid drying method described in JP-A No. 63-25664, a method in which a melted toner is sheared and stirred in an insoluble liquid to form fine particles, a method in which a binding resin and a coloring agent are dispersed in a solvent and fine particles are made from the solution by jet spray, and the like listed.

In the binding resin used in the toner of the present invention, the value of G' at a temperature wherein the value of tan δ is minimum is higher as compared with conventional resins, therefore, there is a tendency that the present resin is not easily ground by the kneading pulverizing method which has been widely used. Therefore, it is preferable to adopt the toner wet production method from among the above-described production methods since an electrophotographic toner which is not limited by the strength of the binding resin can be easily produced.

As a specific example of the toner wet production method, the in-solution drying method will be described in detail below. This in-solution drying method is a method comprising a first process in which a toner composition containing at least a binding resin and a coloring agent is dispersed and dissolved in a volatile solution to prepare a dispersed solution, a second process in which the above-described dispersed solution is dispersed in an aqueous medium, and a third process in which the above-described volatile solvent is removed from the above-described aqueous medium.

The toner composition to be dispersed and dissolved in a volatile solvent in the above-described first process contains at least a binding resin and a coloring agent, and if necessary, contains other components.

The above-described volatile solvent is not particularly restricted providing it can dissolve and disperse the toner composition, and examples thereof include ester-based solvents such as methyl acetate, ethyl acetate, propyl acetate and the like, ether-based solvents such as diethyl ether and the like, ketone-based solvents such as methyl ethyl ketone, methyl isopropyl ketone, methyl isobutyl ketone and the like, hydrocarbon-based solvents such as toluene, cyclohexane and the like, halogenated hydrocarbon-based solvents such as dichloromethane, chloroform, trichloroethylene and the like, as well as other solvents. Among these, cyclohexane and ethyl acetate are particularly preferable in view of their safety, cost, productivity and the like in carrying out industrialization. The above-described volatile solvent preferably has a dissolving rate into water of 0 to 30% by weight.

As the aqueous medium in the second process, for example, media prepared by dispersing an inorganic dispersing agent in water and dissolving a polymer dispersing agent therein uniformly are listed. As the inorganic dispersing agent, hydrophilic agents are preferable, and examples thereof include silica, alumina, titania, calcium carbonate, magnesium carbonate, tricalcium phosphate, clay, diatomaceous earth, bentonite and the like. Among these, calcium carbonate is preferable.

It is preferable that this inorganic dispersing agent is coated with a polymer having a carboxyl group on the surface thereof. As the polymer having a carboxyl group, for example, acrylic resins, methacrylic resins, fumaric acid-based resins, maleic acid-based resins and the like are listed. The inorganic dispersing agent can be dispersed in the above-described water using a dispersing machine such as a ball mill, an ultrasonic dispersing machine, and the like.

In the present invention, in addition to the above-described polymers, there may be used homopolymers of acrylic acid, methacrylic acid, fumaric acid, maleic acid and the like which are constituent monomers of the above-described polymers, and copolymers of these compounds with other vinyl monomers. The above-described carboxyl groups may be metal salts such as sodium salts, potassium salts, magnesium salts and the like. The above-described inorganic dispersing agent usually has an average particle size from 1 to 1000 nm.

As the polymer dispersing agent, hydrophilic agents are preferable, and those having a carboxyl group are particularly preferable, and those having no lipophilic group such as a hydroxypropoxy group, methoxy group and the like are more preferable. As the above-described polymer dispersing agent, for example, carboxymethylcellulose, carboxyethylcellulose and the like are listed. Among these, carboxymethylcellulose is particularly preferable. The polymer dispersing agent is dissolved in water so that the viscosity of the aqueous medium is from 1 to 10000 mPa s at 20° C. The polymer dispersing agent can be dispersed uniformly in water using appropriately selected means, methods and the like.

The above-described second process can be carried out by using an apparatus which can impart a strong shearing force commercially available in general as an emulsifying machine or dispersing machine. Specific examples of the apparatus which can be used include batch-wise emulsifying machines such as Homogenizer (manufactured by IKA K.K.), TK Auto Homomixer (manufactured by Tokusyukika Kogyo Co.,Ltd.) and the like, continuous emulsifying machines such as EBARA Millder (manufactured by EBARA Seisakusyo K.K.), TK Pipeline Homomixier (manufactured by Tokusyukika Kogyo Co.,Ltd.), Colloid-mill (manufactured by Shinko Pantec K.K.), Slusher, Trigonal Wet Microgrinder (manufactured by MITSUI MIIKE Kakouki K.K.), and the like, high pressure emulsifying machines such as Microfluidizer (manufactured by MIZUHO INDUSTRIAL Co.,Ltd.), Nanomizer (manufactured by Nanomizer Inc.), APV GAULIN Homogenizer (manufactured by APPV GAULIN.) and the like, film emulsifying machines such as a film emulsifying machine (manufactured by Reika Kogyo K.K.) and the like, vibration type emulsifying machines such as Vibro Mixer (manufactured by Reica Kogyo K.K.) and the like, ultrasonic emulsifying machines such as Ultrasonic Homogenizer (manufactured by Branson Ultrasonics Corp.) and the like, as well as other machines.

In the third process, the volatile solvent in the aqueous medium is heated and optionally reduced pressure the like to be removed. As the heating temperature, a temperature which is not over the glass transition temperature of the binding resin is preferable. After removal of the volatile solvent, when removal of the aqueous medium, washing, dehydration and the like are conducted, particles of an electrophotographic toner are obtained. When washing and dehydration are conducted, the aqueous medium is treated by an acid, and in some cases, after the acid treatment, an inorganic dispersing agent which has been treated with an alkaline substance is added and dispersed, then there may be conducted washing with water, dehydration and the like.

When a toner is produced by the in-solution drying method, shear applied to the binding resin may be smaller when compared with pulverizing methods such as a kneading pulverizing method and the like, and dispersion of a coloring agent and other components may decrease, therefore, it is particularly preferable that the toner composition is previously melted and kneaded to prepare a colored resin composition, and this colored resin composition is dissolved in a volatile solvent.

The electrophotographic toner of the present invention can be quickly melted and transferred from solid condition to fluidized condition, and further has excellent releasing properties, therefore, when an image is formed using the electrophotographic toner of the present invention, a releasing agent such as oil and the like is scarcely required in the fixing process, and a clear color image can be easily obtained which has high smoothness and high image quality and exhibits high color development.

The electrophotographic toner of the present invention exhibits excellent durability under use conditions wherein heat and pressure are applied to a toner, since G' is high at a temperature where tan δ is the minimum. For example, the electrophotographic toner of the present invention accomplishes the following effects, improvement of heat storage properties of the toner, improvement of storage properties of the fixed image, improvement of powder flowability in a developing machine, improvement of charging ability maintaining properties by the prevention of the embedding of an outer additive into the electrophotographic toner or by the prevention of the pulverizing of the electrophotographic toner due to strong transportation and abrasion, uniform stabilization of charging ability by enabling friction charge under strong stress with charging members such as a carrier, blade and the like in a developing machine, the prevention of filming onto a photosensitive material, improvement of the cleaning ability, and the like.

In particular, these effects are remarkable in the case of an electrophotographic toner in the form of a spherical particle obtained by toner wet production methods such as the above-described in-liquid drying method and the like. Namely, according to the toner wet production method, a toner is obtained having a near-spherical form, and the electrophotographic toner in the form of sphere can obtain an excellent uniform friction charge, and is advantageous not only in fixing properties but also in transferring efficiency when a toner is transferred electrostatically and developing properties, unlike an angular amorphous toner obtained by a kneading pulverizing method. Further, also when wax is added to the toner, the toner obtained in this method carries on its surface a small amount of wax as compared with a pulverizing method, therefore, this method has merits that it can reduce any reduction of flowability due to the existence of wax on the surface, contamination by adhesion inside an apparatus, uneven charging, and the like, without decreasing the effect by wax in developing or transferring, and heat resistant storage properties and the like of a toner before use are further improved.

Next, an electrophotographic toner which uses a polyester resin as the main binding resin and contains a vinyl-based resin for improvement of pulverizing properties and the like (hereinafter, sometimes referred to as a vinyl-based resin-containing toner) will be described in detail below.

The polyester resin used in the vinyl-based resin-containing toner has viscoelastic properties in which the minimum value of tan δ exists between Tg and a temperature at which G" is $1\times10^4$ Pa, the minimum value of tan δ is less than 1.2, G' is $5\times10^5$ Pa or more at a temperature wherein tan δ is minimum, and the value of tan δ is 3 or more at a temperature wherein G"=$1\times10^4$ Pa, like the above-described binding resin. Therefore, polyester resins which can be used as the above-described binding resin can all be used.

Further, it is preferable that the polyester resin is composed of at least two kinds of resins (C, D), and in the resin (C), Tg is from 45° C. to 65° C., the minimum value of tan δ exists between Tg and a temperature wherein G"=$1\times10^4$ Pa, tan δ is less than 1.0, and the value of tan δ is 1.0 or more at a temperature wherein G"=$1\times10^4$ Pa, and in the resin (D), Tg exists between Tg+5° C. and Tg+15° C. of the resin (C), and the minimum value of tan δ exists between Tg and a temperature wherein G"=$1\times10^4$ Pa, and as the whole polyester resin, the above-described viscoelastic property is satisfied.

It is necessary that the polyester resin is contained in an amount of 70% by weight or more based on the total weight of binding resins, as the main binding resin of the vinyl-based resin-containing toner of the present invention.

The reason for this content is that since the above-described viscoelastic property is manifested by the polyester resin, when the content thereof decreases, electrophotographic properties such as offset resistance, coloring properties and the like necessarily decrease. In particular, hot offset resistance remarkably lowers.

Further, it is necessary that the above-described vinyl-based resin is contained in the vinyl-based resin-containing toner of the present invention in an amount in the range from 0.5% by weight to 20% by weight, preferably in the range from 1% by weight to 15% by weight, and more preferably in the range from 1.5% by weight to 10% by weight based on the total weight of binding resins. The vinyl-based resin contributes to improvement of pulverizing properties when a toner is produced by a kneading pulverizing method, and contributes to improvement in solubility for a solvent when a toner is produced by an in-solution drying method. Therefore, when the content of the vinyl-based resin is too small, the effect of improvement of productivity is not obtained, and when too large, offset resistance and winding resistance are reduced. The reason for this is that vinyl-based resins have a lower value of G' at a temperature wherein tan δ is minimum as compared with polyester resins, as a property of the resins themselves.

In the above-described vinyl-based resin, the weight-average molecular weight (Mw) is required to be less than 100,000, preferably the weight-average molecular weight (Mw) is from 1000 to 100,000, more preferably from 1000 to 50,000, and most preferably from 12000 to 50,000. When Mw is too large, the effect of improving pulverizing properties diminishes, when Mw is too small, the content of volatile components increases and a nasty smell is generated in fixing and problems occur regarding safety.

As the monomers constituting the above-described vinyl-based resin, for example, conventionally known monomer components as described in "Polymer Data Handbook: Basic volume" (The society of polymer science Japan ed.: BAIHUUKAN) can be used alone or in combination. Specific examples thereof as styrene-based monomers include styrene, α-methylstyrene, vinylnaphthalene and alkyl-substituted styrenes having an alkyl chain such as 2-methylstyrene, 3-methylstyrene, 4-methylstyrene, 2-ethylstyrene, 3-ethylstyrene, 4-ethylstyrene and the like; halogen-substituted styrenes such as 2-chlorostyrene, 3-chlorostyrene, 4-chlorostyrene and the like; fluorinesubstitued styrenes such as 4-fluorostyrene, 2,5-difluorostyrene and the like.

Examples of (meth)acrylic monomers include (meth) acrylic acid, n-methyl (meth)acrylate, n-ethyl (meth) acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth) acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, phenyl (meth) acrylate, biphenyl (meth)acrylate, diphenylethyl (meth) acrylate, t-butylphenyl (meth)acrylate, terphenyl (meth) acrylate, cyclohexyl (meth)acrylate, t-butylcyclohexyl (meth)acrylate, dimethylaminoethyl (meth)acrylate, diethylaminoethyl (meth)acrylate, methoxyethyl (meth)acrylate, 2-hydroxyethyl (meta)acrylate, (meth)acrylonitrile, (meth) acrylamide and the like.

Further, examples of vinylmonomer components having crosslinking properties include aromatic divinyl compounds, for example, divinylbenzene, divinylnaphthalene and the like; diacrylate compounds connected by an alkyl chain, for example, ethylene glycol diacrylate, 1,3-butylene glycol diacrylate, 14,-butanediol diacrylate, 1,5-pentanediol diacrylate, 1,6-hexanediol diacrylate, neopentyl glycol diacrylate; and compounds obtained by substituting acrylate by methacrylate in the above-described compounds;

diacrylate compounds connected by an alkyl chain containing an ether bond, for example, diethylene glycol diacryalte, triethylene glycol diacrylate, tetraethylene glycol diacrylate, polyethylene glycol #400 diacrylate, polyethylene glycol #600 diacrylate, dipropylene glycol diacrylate; and compounds obtained by substituting acrylate by methacrylate in the above-described compounds;

diacrylate compounds connected by a chain containing an aromatic group and an ether bond, for example, polyoxyethylene(2)-2,2,bis(4-hydroxyphenyl)propane diacrylate, polyoxyethylene(4)-2,2-bis(4-hydroxyphenyl)propane diacrylate; and compounds obtained by substituting acrylate by methacrylate in the above-described compounds;

and examples of polyfunctional cross-linking agents include pentaerythritol triacrylate, trimethylolmethane triacrylate, trimethylolpropane triacrylate, tetremethylolmethane tetraacrylate, oligoester acrylate; and compounds obtained by substituting acrylate by methacrylate in the above-described compounds. However, since there is a fear that a large amount of cross-linking components deteriorate the color developing properties of a toner, the amount used of the components preferably should be 10 mol % or less in terms of molar ratio by weight.

Since a styrene-based monomer has a great effect for improving heat blocking resistance among vinyl-based monomers, it is preferable that the above-described vinyl-based resin contains a styrene-based monomer as a constituent unit. Specifically, the content of the styrene-based monomer based on the total weight of all monomers in the vinyl-based resin is preferably from 10 mol % to 90 mol %, and more preferably from 20 mol % to 80 mol % in terms of molar ratio by weight.

Since an acrylic monomer has effect in suppressing the turbidity of a toner because it has excellent compatibility with a polyester resin due to the existence of a carbonyl bond in the monomer, it is further preferable that the above-described vinyl-based resin also contain an acrylic monomer as a constituent unit. Specifically, the content of the acrylic monomer based on the total weight of all monomers in the vinyl-based resin is preferably from 2 mol % to 80 mol %, and more preferably from 5 mol % to 60 mol % in terms of molar ratio by weight. When the content of the acrylic monomer is too small, compatibility is poor, and when too large, compatibility is excessive and the effect obtained by the addition is not achieved.

Especially when the Mw of the vinyl-based resin is 30,000 or more, the effect of including of an acrylic monomer is remarkable. Among acrylic monomers, (meth) acrylates such as n-pentyl (meth)acrylate, n-hexyl (meth) acrylate, isobutyl (meth)acrylate, t-butyl (meth)acrylate and the like are preferable in view of their marked effect in improving toner production properties.

The glass transition temperature of the above-described vinyl-based resin is preferably in the range of not less than 50° C. When Tg is less than 50° C., the toner is easily blocked by heat.

In the vinyl-based resin-containing toner of the present invention, a coloring agent and, additives for improving properties can be used together providing the effect of the present invention is not lost. As the coloring agent and additives, those described above can be used.

The production of the vinyl-based resin-containing toner of the present invention can be conducted according to the above-described conventionally known methods, and the vinyl-based resin-containing toner of the present invention is characterized in that pulverizing properties of a toner material are improved by the addition of a vinyl-based resin without losing the effects of limiting viscoelastic properties, and is suitable for a kneading pulverizing method. Therefore, as the method for producing the vinyl-based resin-containing toner of the present invention, a kneading pulverizing method and an in-solution drying method are most suitable.

The vinyl-based resin-containing toner of the present invention can be quickly melted and transferred from a solid condition to a liquid condition like the above-described electrophotographic toner, and further is excellent in releasing properties, therefore, when an image is formed using the electrophotographic toner of the present invention, a releasing agent such as oil and the like is scarcely required in the fixing process, and a clear color image can be easily obtained which has high smoothness and high image quality and exhibits high color development, and further, excellent durability can be obtained under conditions of use wherein heat and pressure are applied to the toner, since G' is high at a temperature wherein tan $\delta$ is the minimum.

The electrophotographic toner of the present invention described above (hereinafter, when referring to electrophotographic toners, vinyl-based resin-containing toners are also included) can be suitably used as a toner in an electrophotographic developer.

Next, the electrophotographic developer of the present invention will be described. The electrophotographic developer of the present invention contains the above-described electrophotographic toner.

The electrophotographic developer of the present invention may be a one-component type electrophotographic developer containing the electrophotographic toner of the present invention, or a two-component type electrophotographic developer containing the electrophotographic toner and a carrier. In the case of the one-component type electrophotographic developer, the binding resin used in the toner of the present invention has a high value of G' and is strong against heat and abrasion, therefore, if a non-magnetic one-component developer which is charged by being abraded with a charging member such as a blade and the like is provided, the developer is obtained as a material which has excellent abrasion resistance with the member, has uniform charging ability, exhibits little change due to abrasion with the passing of time, and has excellent heat resistance. In the case of the two-component electrophotographic developer, the carrier used together with the toner is not particularly restricted, and known carriers, for example, a resin-coated carrier and the like are suitably listed. The resin-coated carrier comprises a core material whose surface is coated with a resin, and as the core material, for example, powders having magnetic properties such as iron powder, ferrite powder, nickel powder and the like are listed. As the coating resin, for example, fluorine based resins, vinyl-based resins, silicone-based resins and the like are listed.

The two-component electrophotographic developer using the toner of the present invention also has excellent abrasion resistance with a carrier, does not cause adhesion on the surface of the carrier due to wax, and can maintain uniform charging ability, like the one-component developer, therefore, there can be obtained an electrophotographic developer excellent in developing properties, transferring properties, and durability.

The electrophotographic developer of the present invention may contain additive suitably selected according to the purpose. For example, for the purpose of obtaining magnetic properties, irons including iron, ferrite, magnetite, metals showing strong magnetic properties such as nickel, cobalt and the like, alloys thereof, or compounds containing these metals, magnetic materials, and materials which can be endowed with magnetic properties may be included.

Since the electrophotographic developer of the present invention contains the electrophotographic toner of the present invention described above, the merits of the electrophotographic toner of the present invention can be applied to the merits of the electrophotographic developer of the present invention without any change. Therefore, when an image is formed using the electrophotographic developer of the present invention, a clear color image is obtained which has high smoothness and high image quality and exhibits high color development. The electrophotographic developer of the present invention described above can be suitably used in various image forming methods.

The image forming method of the present invention is characterized in that the electrophotographic developer of the present invention is used as an electrophotographic developer. As the process in the image forming method of the present invention, there may be adopted known image forming processes, for example, a process in which a latent image is formed on a latent carrier, a process in which the above-described latent image is developed using an electrophotographic developer, a process in which the developed toner image is transferred onto a transfer material, a process in which the toner image on the transfer material is fixed, and the like.

As the fixing apparatus used in the image forming method of the present invention, a contact type heat fixing apparatus equipped with known releasing agent-coating means can be used, for example, there can be used a heat roller fixing apparatus composed of a heat roller comprising a core metal material having thereon a rubber elastic layer and optionally having a fixing member surface layer, and a pressure roller comprising a core metal material having thereon a rubber elastic layer and optionally having a fixing member surface layer, and fixing apparatuses obtained by substituting such a combination of a roller and a roller by a combination of a roller and a belt, or a combination of a belt and a belt.

As the rubber elastic layer, heat resistant rubber such as silicon rubber, fluorine rubber and the like is used. As the fixing member surface layer, there is used a layer composed of a material having low surface energy such as silicon rubber, fluorine rubber, fluorine latex, fluorine resin and the like. Since the toner of the present invention is excellent in releasing properties, excellent reliability is obtained when such a fixing member surface layer is used, and among these, by using a fluorine resin, fixing ability having high reliability can be obtained for a long period of time.

As the fluorine resin used in the fixing member surface layer, Teflon such as PPA (perfluoroalkoxy ethyl ether copolymer) and the like, soft fluorine resins containing vinylidene fluoride and the like can be used. Since the fluorine resin does not show any reduction in releasing properties due to adhesion and deposition such as toner stain and the like as compared with silicone rubber and fluorine rubber, if the releasing properties of a toner are sufficient, a fixing member having a longer life is obtained.

As the base material (core) of the above-described fixing member, materials are selected which have excellent heat resistance, high strength against deformation and excellent heat conductivity, and in the case of a roll type fixing apparatus, for example, aluminum, iron, copper and the like are selected, and in the case of a belt type fixing apparatus, for example, polyimide film, stainless belt and the like are selected.

The above-described fixing member may contain various additives according to the purpose, and for example, carbon black, metal oxide, ceramic particles such as SiC and the like may be contained for the purpose of improving abrasion properties, controlling resistance, and the like.

Figure 3:
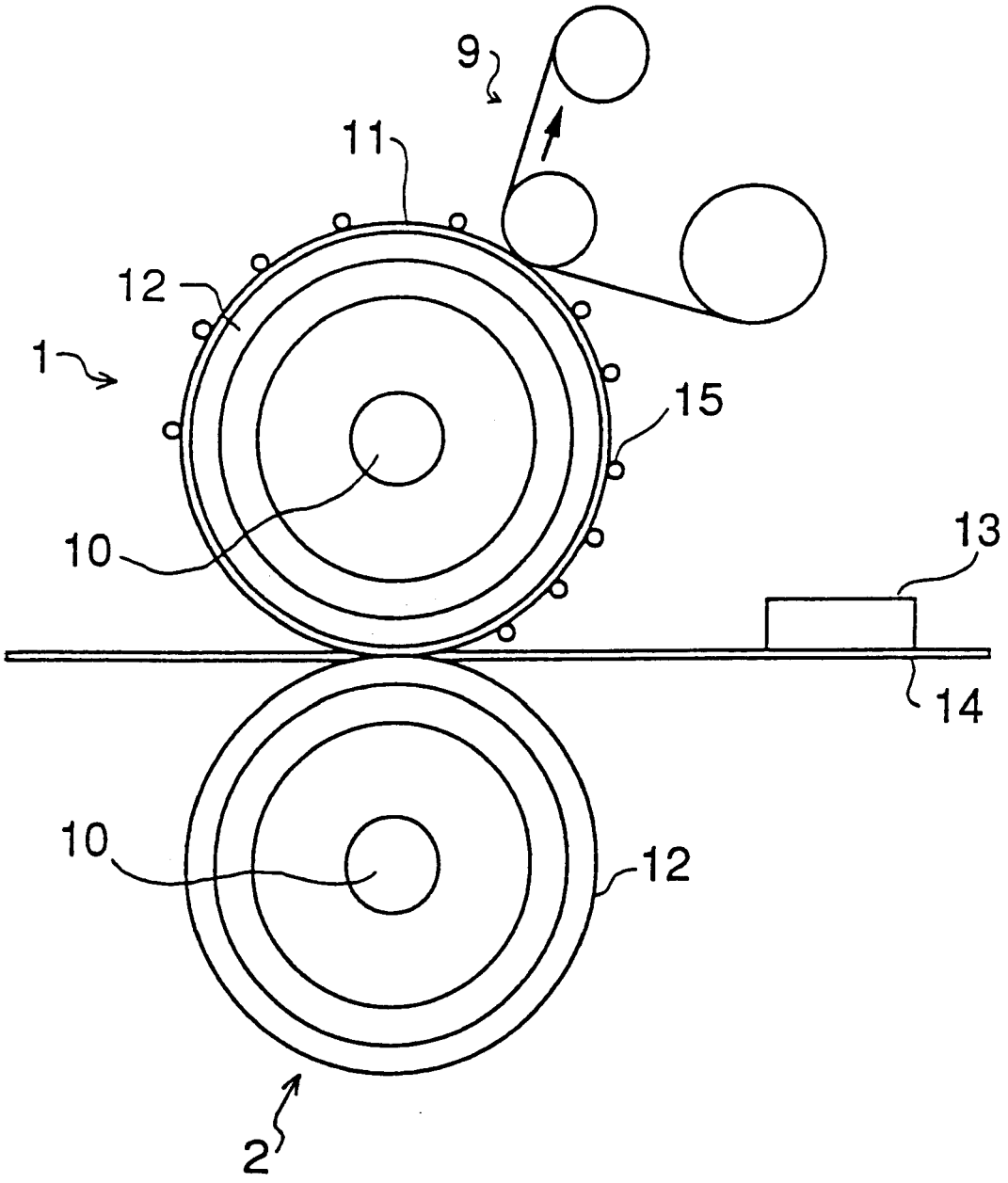
FIG. 3 is a schematic structural view showing an example of a heat fixing apparatus used in the image forming method of the present invention.

The fixing process using the developer of the present invention will be illustrated in detail using FIG. 3.

The heat pressing apparatus shown in FIG. 3 is an apparatus in which a fixing member has the form of a roller, and comprises a heat roller 1, a pressure roller 2 placed facing the roller 1, a heat source 10 for heating the heat roller 1, and a releasing agent supplying apparatus 9 which supplies a releasing agent 15 to a fixing member surface layer 11 on the surface of the heat roller 1. An elastic layer 12 is formed on the surface of the heat roller 1. When a transfer material 14 on which a toner image 13 is formed passes between the pressure roller 2 and the heat roller 1, it is heated and pressed thereby carrying out fixing of the image.

The heat pressing apparatus shown in FIG. 3, may further comprise a cleaning member for removing toner adhered to the surface of the heat roller 1, a heat source 10 for heating the pressure roller 2, a finger for releasing recording material from the heat roll 1, and the like, according to need. The heat source 10 in the heat pressing apparatus shown in FIG. 3 is controlled by a temperature control apparatus (not shown).

The heat roller 1 and/or pressure roller 2 preferably comprise an elastic layer 12 having a mono layer or laminated layer structure, and the thickness of the elastic layer is preferably from 0.1 to 3 mm, and more preferably from 0.5 to 2 mm. As the elastic layer 12, a heat resistant rubber such as silicone rubber, fluorine rubber and the like is used, and the rubber hardness is preferably 60 or less. When the fixing member has the elastic layer 12, the fixing member is deformed following unevenness of a toner image 13 on the transfer material 14, and smoothness on the image surface after fixing can be advantageously improved. When the thickness of the elastic layer is over 3 mm and is thus too thick, the heat capacity of the fixing member increases, a longer timer is necessary for heating the fixing member to a given temperature, and further, energy consumed increases. On the other hand, when the thickness of the elastic layer is less than 0.1 mm and is thus too thin, the deformation of the fixing member cannot follow unevenness of the toner image, uneven melting occurs, and strain in the elastic layer effective for releasing is not obtained.

Since a developer having excellent releasing properties is used in the image forming method of the present invention, when a fixing member having a surface layer composed of a member having low surface energy is applied, though coating of a releasing agent on the surface of the fixing member in heat pressing is not particularly required, a releasing agent may be coated on the surface of the fixing member in order to improve durability and releasing properties of the fixing member, and the amount coated is preferably from $1.6\times10^{-5}$ to $8.0\times10^{-4}$ mg/cm$^2$ corresponding to the amount coated in monochrome toner fixing.

The amount coated of the releasing agent is preferably as small as possible in view of smoothness, gloss and the like of the resulting image, however, when the amount supplied of the releasing agent is 0 mg/cm$^2$, the amount abraded of the fixing member in contact between the fixing member and a transfer material such as paper and the like increases in fixing process, and accordingly there is a fear that the durability of the fixing member will be reduced, therefore, it is practically preferable to supply a small amount of a releasing agent to the fixing member.

When the amount supplied of the releasing agent is over $8.0\times10^{-4}$ mg/cm$^2$ (0.5 mg per one piece of A4paper), image quality decreases due to releasing agent remaining on the surface of the image after fixing, and particularly when a transmitted light such as an OHP is used, reduction in image quality is remarkable, and releasing agent adheres to the transfer material and stickiness occurs, and the like. Further, the amount supplied of a releasing agent increases, there occurs also the problem that the capacity of the tank for storing the releasing agent increases and the size of the fixing apparatus increases.

The amount supplied of a releasing agent is measured as described below. Namely, when normal paper (typically, copying paper manufactured by Fuji Xerox Corp., trade name "J paper") used in a general copying machine is passed through a fixing member to whose surface a releasing agent is supplied, the releasing agent adheres to the normal paper. The releasing agent on the normal paper is extracted using a Soxhlet extraction apparatus. As the solvent, hexane is used. The releasing agent contained in hexane is quantified by an atomic absorption analysis apparatus to quantify the amount of the releasing agent adhered to the normal paper. This amount is defined as the amount supplied to the fixing member of the releasing agent.

The releasing agent used is not particularly restricted, and there are listed liquid releasing agents such as heat resistant oil, for example, dimetylsilicone oil, fluorine oil, fluorosilicone oil, modified oil such as amino-modified silicone oil and the like.

As the releasing agent, fluorine oil, fluorosilicone oil and the like which have high performance but are expensive can be used without practical problems in the cost aspect, since the amount supplied of the releasing agent may be extremely small in the case of the image forming method of the present invention.

The method for supplying a releasing agent to the surface of the heat roller of the heat pressuring apparatus is not particularly restricted, and for example, a pad method in which a liquid releasing agent is impregnated, a web method, a roller method, a no-contact type shower method (spray method), and the like are listed. Among these, a web method and a roller method are preferable from the viewpoints that the releasing agent can be supplied uniformly and the amount supplied can be easily controlled. In the shower method, it is necessary to use a blade and the like separately, for supplying the releasing agent uniformly over all the fixing member.

As the transfer material (recording material) used in the image forming method of the present invention, for example, normal paper, OHP sheets and the like used in a copying machine, printer and the like in electrophotographic mode are listed. For further improving the smoothness of the image surface after fixing, it is preferable that the surface of the above-described transfer material is also as smooth as possible, and for example, there can be suitably used coated paper prepared by coating the surface of normal paper with a resin and the like, art paper for printing, and the like as the above-described transfer material.

When a light transmitted image is formed, as the transfer material (recording material), a transparent plastic film, a transparent sheet comprising a substrate such as a transparent plastic film and the like carrying thereon an image-receiving layer composed of a thermoplastic resin, and the like are used.

As the substrate, specifically, polyethylene terephthalate film (hereinafter, abbreviated as PET), polyethylene naphthalate film (hereinafter, abbreviated as PEN), polysulfone film, polyphenylene oxide film, polyimide film, polycarbonate film, cellulose ester film, polyamide film and the like having a heat resistant temperature of 100° C. or more can be used, and among these, PET and PEN are particularly preferable from the points of heat resistance and transparency. The reason for this is that when the heat resistant temperature is too low, the substrate is deformed and winds around a fixing apparatus in fixing. There is no upper limit in the usable range of electrophotography, however, in view of molding properties and recycling and the like, those melted at about 250° C. are desirable.

The thickness of the substrate is preferably from about 20 μm to 200 μm. The reason for this is that when the substrate is too thick, light transmission deteriorates, and the fixing temperature is required to be raised because of increased heat capacity in fixing. On the other hand, a thinner substrate has no problem in fixing, however, in view of the properties of current substrate materials, the lower limit is necessary since when too thin, the substrate itself tends to be deformed, and winding around a fixing apparatus easily occur in fixing.

As a thermoplastic resin forming an image-receiving layer, in general, in the case of monochrome copy for oil-less fixing, resins having high elasticity such as a styrene butadiene resin and the like are used since color developing ability is not required, and in the case of color copying utilizing fixing using oil, polyester resins and the like having the same viscous properties as those of a toner resin having sharp melting properties are used since color developing is required, and it is preferable to use the same materials as the binding resins constituting the electrophotographic toner of the present invention since they are excellent in melting properties at lower temperatures and are also excellent in releasing properties. Further, it is preferable to use in an image-receiving layer a resin having a similar composition to the binding resin of a toner since excellent compatibility is obtained due to scarce differences in refractivity and solubility parameters (SP value), and color developing properties and light transmittance are not lost.

Specifically, it is preferable to form an image-receiving layer using a resin in which the minimum value of tan δ of the resin exists between the glass transition temperature (Tg) and a temperature at which the loss modulus (G") is $1\times10^4$ Pa, the minimum value of tan δ is less than 1.2, the storage modulus (G') is $5\times10^5$ Pa or more at a temperature wherein tan δ is minimum, and the value of tan δ is 1.0 or more at a temperature wherein $G''=1\times10^4$ Pa.

This resin differs from the above-described toner in that tan δ is 1.0 or more at a temperature wherein $G''=1\times10^4$ Pa. The reason for this difference is that an image-receiving layer is not required to have the same flowability as that of a toner which should be fluidized to form a smooth image from particulate condition in fixing since the image-receiving layer is previously made as a smooth layer.

These numerical ranges are at least required, and since a lower minimum value of tan δ is advantageous for releasing, it is preferably less than 1.1, and more preferably less than 1.0. There is no lower limit in view of releasing, however, it is preferably 0.3 or more since solubility into a solvent and the like is required from the viewpoint of coating productivity and the like. Further, G' at a temperature wherein tan δ is minimum is preferably $6\times10^5$ Pa or more, and further preferably $7\times10^5$ Pa or more. Further, the value of tan δ is preferably 2.0 or more, and more preferably 3.0 or more at a temperature wherein $G''=1\times10^4$ Pa.

Within these viscoelasticity ranges, viscous property is obtained in fixing nips, edge parts of a toner image are buried in the image-receiving layer, elastic behavior is exhibited in releasing, and excellent releasing property is obtained. Since the edge parts of a toner image are buried in the image-receiving layer, a projected image in the middle tone image parts is allowed to be developed clearly. The fact that the temperature, at which $G''=1\times10^4$ Pa, is 180° C. or less is preferable for lowering the fixing temperature.

The glass transition temperature (Tg) of the binding resin of the present invention is preferably in the range from 45 to 85° C., more preferably in the range from 50 to 75° C., and most preferably in the temperature range from 55 to 70° C. When Tg is lower than 45° C., a toner is easily blocked by heat, and when over 100° C., the fixing temperature rises too high. As standards of the molecular weight for obtaining the viscoelastic property in the present invention, the molecular weight Mn by GPC is from 5000 to 10000, Mw is from 13000 to 25000, Mz is from 20000 to 70000, and Mw/Mn is from 3 to 5. As the thermoplastic resin forming the image-receiving layer, resins which can be used as the above-described binding resin of the electrophotographic toner of the present invention can all be used providing the above-described conditions are satisfied.

It is preferable to use two or more resins together as the above-described thermoplastic resin forming the image-receiving layer from the viewpoints that the fixing temperature is set at a lower temperature side and heat blocking resistance is improved. Specifically, it is preferable that the above-described thermoplastic resin contains at least two kinds of resins (E, F), and in at least one resin (E), Tg is from 45° C. to 65° C., the minimum value of tan δ of the resin exists between Tg and a temperature wherein $G''=1\times10^4$ Pa, the minimum value of tan δ is less than 1.0, and the value of tan δ at a temperature wherein $G''=1\times10^4$ Pa is 1.0 or more, and in the resin (F) used together, Tg exists between Tg+5° C. and Tg+15° C. of the resin (E), and the minimum value of tan δ of this resin exists between Tg and a temperature wherein $G''=1\times10^4$ Pa.

When a temperature at which G" of the thermoplastic resin forming the image-receiving resin is $1\times10^4$ Pa is designated as Tf, and a temperature at which G" of the toner is $1\times10^4$ Pa is designated as Tt, the difference between Tf and Tt (Tf−Tt) is preferably in the range from −30 to 30° C., and more preferably in the range from −20 to 20° C. When this difference is larger than this, their viscosities in melting are significantly different, and color developing properties and offset resistance may sometimes be lost.

The above-described image-receiving layer can be formed by a conventionally known method. In general, there are listed a method in which a thermoplastic resin and other additives are dissolved in a solvent and the mixture is coated by a spin coater, bar coater and the like and dried, and a method in which an emulsion is coated and heated and melted to obtain a smooth surface. For improving adhesion between the substrate and image-receiving layer, an adhesive layer may be provided, and treatments such as plasma treatment, corona discharge and the like may also be performed on the surface of the substrate. The coating thickness of the image-receiving layer is preferably 1 μm or more and 20 μm or less. When the image-receiving layer is too thin, the effect for improving the color developing properties is small, and if too thick, offset resistance decreases.

The above-described image-receiving layer can contain various conventionally known additives for further improvement of abilities. For example, the above-described image-receiving layer may contain a releasing agent for improving releasing properties. As the releasing agent to be contained, the same agents as contained in the above-described toner can be used. When the amount of the releasing agent is too large, light transmission is lost though releasing properties become advantageous, therefore, the amount of the releasing agent is preferably 5% by weight or less based on the resin constituting the image-receiving layer. The releasing agent may be appropriately selected in view of compatibility with the resin, and when dispersing diameter in the image-receiving layer is 1.0 μm or less, light transmission can be improved. When the releasing agent is dissolved in a solvent, the solution is coated without any treatment, and even if the releasing agent is not dissolved in a solvent, it is possible for the releasing agent to be previously ground to 0.5 μm or less, preferably 0.3 μm or less, and the ground agent dispersed in a solvent and the dispersion coated and dried to keep the dispersion diameter small. The drying in this case is preferably conducted at the melting point of the releasing agent or less in view of prevention of coagulation of the releasing agent.

Further, the above-described image-receiving layer may contain fine particles for controlling the friction coefficient. As the fine particles to be contained, those having a difference in refractivity from the image-receiving layer of 0.2 or less are preferable, and specifically, inorganic fine particles such as silica, alumina, calcium carbonate and the like, organic fine particles such as polystyrene, polymethyl methacrylate and the like, can be used. The content thereof is preferably in the range from 0.1 to 10% by weight.

The surface electric resistance of the above-described image-receiving layer is preferably from $10^7$ to $10^{13}$ Ω/cm$^2$. When the surface electric resistance is higher than $10^{13}$ Ω/cm$^2$, deterioration of an image by discharge easily occurs, and when the surface electric resistance is lower than $10^7$ Ω/cm$^2$, charge for retaining a toner lowers, and an image may sometimes deteriate. The surface electric resistance of the above-described image-receiving layer can be controlled by a charge controlling agent. The charge controlling agent can be contained in the image-receiving layer. Alternatively, a layer containing the charge controlling agent may newly formed on the image-receiving layer.

As the charge controlling agent, those which are colorless and transparent are preferable, and for example, sulfonate salts, ammonium salts, sulfonium salts and metal oxide fine particles, and the like can be used. When dispersion of these charge controlling agents is poor, bias of the surface resistance occurs, and an image deteriorates, therefore, these charge controlling agents are ground by a media pulverizing machine to obtain a fine particle for use. Preferably, these fine particles are previously kneaded in the resin of the present invention to fully enhance dispersibility and the resulting mixture is used for a coating process, and the like. The measurement of the surface resistance can be conducted according to a method prescribed in JIS-K 6911. Namely, a sample is left for 24 hours at 20° C. and 65% RH, then, the surface resistance is measured using a resistance measuring apparatus "R8340 (manufactured by Advantest Corporation.)" and the like at 100 volts.

According to the image forming method of the present invention using the electrophotographic toner and the electrophotographic developer of the present invention, tensile processing and writing properties are excellent since adhesion of a releasing agent onto a transfer material is scarcely recognized, and even in both side copying, generation of oil adhesion contamination onto parts of the machine, for example, feeder rolls, transferring members and the like can be prevented.

As described above, according the electrophotographic toner of the present invention, since the toner binder has the above-described viscoelastic properties, the toner quickly flows through a fixing apparatus, and in releasing, because a strong entanglement exists between binder molecules and the binder becomes elastic, sufficient releasing is secured even when the amount of the image toner is large and the thickness is large, and an image after fixing has also high quality and high color developing properties. Further, due to the strong entanglement existing between the binder molecules, even when the amount of the image toner is large and the thickness of the toner layer is large, the toner binder exhibits elastic behavior due to releasing strain in fixing and sufficient releasing can be secured, and an image after fixing has also high quality and high color developing properties, and excellent light transmission. Further, because of the excellent releasing properties of the toner binder itself, the amount of the releasing agent used in a fixing apparatus can also be remarkably reduced, therefore, tensile processing properties and writing properties of a print are excellent, and even in both side copying, generation of oil adhesion contamination onto parts of the machine, for example, feeder rolls, transferring members and the like can be prevented. Further, even when a releasing agent is contained in the toner for further improving offset resistance ability, the effect can be exhibited by an extremely small amount of a releasing agent, therefore, reduction of various toner properties due to inclusion of the releasing agent can be suppressed to minimum. Further since the minimum value of tan δ of the toner binder is less than 1.2, namely, the strength of the toner binder is high, there are expected effects, in addition to the releasing properties, such as improvement in the copy storage properties due to improvement of image strength after fixing, reduction of impregnation of a toner into a recording material such as paper and the like, improvement of durability of a toner in a developing apparatus, reduction of contamination of a photosensitive material, improvement of cleaning properties, and the like.

EXAMPLES

The following examples and comparative examples further illustrate the present invention, but they do not limit the scope thereof at all.

Synthesis Example of Polyester Resin 1

Into a reaction vessel equipped with a stirrer, thermometer, condenser, and nitrogen gas introducing tube, were charged 72.1 parts by weight of cyclohexanedimethanol, 67.9 parts by weight of dimethyl terephthalate, 87.3 parts by weight of dimethyl isophthalate, 40.0 parts by weight of dimethyl cyclohexanedicarboxylate, and 1.0 part by weight of titanium tetrabutoxide as a catalyst, as shown in Table 1, and the reaction vessel was purged with a dry nitrogen gas, then, heated in a mantle heater, and reaction was conducted at about 190° C. for about 5 hours under nitrogen gas flow. Then, the reaction mixture was cooled to room temperature, to this was added 124 parts by weight of ethylene glycol and 0.5 parts by weight of titanium tetrabutoxide, and further, reaction was conducted at about 190° C. for about 5 hours under nitrogen gas flow. The reaction mixture was cooled to about 100° C. with continuing stirring, it was confirmed that no acid component monomers were remaining by silica thin layer chromatography (TLC), then, the pressure inside the reaction vessel was reduced to about 0.6 mmHg, the temperature in the reaction vessel was raised to about 230° C. at a rate of about 10° C./5 minutes, the reaction was continued for about 2 hours at 230° C. at the same conditions, to obtain a pale yellow transparent amorphous polyester resin A. The physical properties of the amorphous polyester resin A are as shown in Table 2.

Synthesis Example of Polyester Resin 2

Into the same reaction vessel as in Synthesis Example of Polyester Resin 1, were charged 72.1 parts by weight of cyclohexanedimethanol, 77.6 parts by weight of dimethyl terephthalate, 87.3 parts by weight of dimethyl isophthalate, 30.0 parts by weight of dimethyl cyclohexanedicarboxylate, and 1.0 part by weight of titanium tetrabutoxide as a catalyst, as shown in Table 1, and the reaction vessel was purged with a dry nitrogen gas, then, heated in a mantle heater, and reaction was conducted at about 190° C. for about 5 hours under nitrogen gas flow. Then, the reaction mixture was cooled to room temperature, to this was added 124 parts by weight of ethylene glycol and 0.5 parts by weight of titanium tetrabutoxide, and further, reaction was conducted at about 190° C. for about 5 hours under nitrogen gas flow. The reaction mixture was cooled to about 100° C. with continuing stirring, and it was confirmed that no acid component monomers were remaining by silica thin layer chromatography (TLC), then, the pressure inside the reaction vessel was reduced to about 1.0 mmHg, the temperature in the reaction vessel was raised to about 230° C. at a rate of about 10° C./5 minutes, the reaction was continued for about 1 hour at 230° C. in the same conditions, to obtain a colorless transparent amorphous polyester resin B. The physical properties of the amorphous polyester resin B are as shown in Table 2.

Synthesis Example of Polyester Resin 3

Into a reaction vessel equipped with a stirrer, thermometer, condenser, and nitrogen gas introducing tube, were charged 116.4 parts by weight of dimethyl terephthalate, 77.6 parts by weight of dimethyl isophthalate, 211.3 parts by weight of bisphenol A ethylene oxide 2 mol adduct, 24.1 parts by weight of ethylen glycol, and 2.0 parts by weight of dibutyltin oxide as a catalyst, as shown in Table 1, and the reaction vessel was purged with a dry nitrogen gas, then, reaction was conducted at about 200° C. for about 5 hours under nitrogen gas flow, then, the reaction mixture was heated to about 240° C. and reacted for about 5 hours with stirring, to obtain a colorless transparent amorphous polyester resin C. The physical properties of the amorphous polyester resin C are as shown in Table 2.

Synthesis Example of Polyester Resin 4

An amorphous polyester resin D was obtained in a like manner as in Synthesis Examples of Polyester Resin 1 and 2 according to the composition ratio shown in Table 1, with adding ethylene glycol in excess, and changing the degree of reduction and the reaction time. The physical properties of the amorphous polyester resin D are as shown in Table 2.

Synthesis Example of Polyester Resin 5

An amorphous polyester resin E was obtained in a like manner as in Synthesis Example of Polyester Resin 3 according to the composition ratio shown in Table 1, with changing the reaction time. The physical properties of the amorphous polyester resin E are as shown in Table 2.

Synthesis Example of Polyester Resin 6

An amorphous polyester resin F was obtained in a like manner as in Synthesis Examples of Polyester Resin 1 and 2 according to the composition ratio shown in Table 1, with adding ethylene glycol in excess, and changing the degree of reduction and the reaction time. The physical properties of the amorphous polyester resin F are as shown in Table 2.

Synthesis Example of Styrene-Acryl Copolymer Resin 1

To a reaction vessel, after purging with a dry nitrogen gas of the system, were added 780 parts by weight of tetrahydrofuran (hereinafter, abbreviated as THF) from which water had been removed sufficiently as a solution, and 265.2 parts by weight of styrene and 57.6 parts by weight of n-butyl acrylate as monomers, and N,N'-azobisisobutyronitrile (hereinafter, abbreviated as AIBN) in an amount about 1/100 mole based on the total amount of all monomers, and the system was heated to 60° C., and reaction was conducted for about 48 hours at the same temperature. After completion of the reaction, the solution was dropped into about 7000 parts by weight of methanol slowly with stirring, the precipitate was filtered then dried, to obtain a colorless transparent amorphous styrene-acryl copolymer resin G. The physical properties of the amorphous polyester resin G are as shown in Table 2.

Synthesis Example of Vinyl-based Resin 1

To a reaction vessel was added 500 parts by weight of cumene, the reaction vessel was purged with a nitrogen gas, and the mixture was heated to about 150° C. To this was added a mixed solution into which 250 parts by weight of styrene and 5 parts by weight of benzoyl peroxide had been dissolved drop-wise over 3 hours, polymerization reaction was conducted at about 150° C. for about 2 hours, then, slowly heated to 190° C. under reduced pressure to remove cumene to obtain a colorless transparent styrene resin H having a Mw of 15000, a Mn of 3000 and a Tg of 72.1° C.

Synthesis Example of Vinyl-based Resin 2

A colorless transparent styrene-acryl copolymer resin K having a Mw of 36000, a Mn of 12000 and a Tg of 71.1° C. was obtained in a like manner as in Synthesis Example of Vinyl-based Resin 1, with selecting monomers so that copolymerization ratio of styrene, t-butyl methacrylate and n-butyl acrylate is 6:3:1.

Synthesis Example of Vinyl-based Resin 3

A colorless transparent styrene-acryl copolymer resin L having a Mw of 110000, a Mn of 7000 and a Tg of 68.8° C. was obtained in a like manner as in Synthesis Example of Vinyl-based Resin 1, with selecting monomers so that copolymerization ratio of styrene, t-butyl acrylate is 9:1.

In Table 1 below, compositions of the polyester resins A to F and styrene-acryl resin G used as a binding resin are shown in terms of charging amount, and numerical value shows party weight in charging, numerical value in bracket shows mol number.

In Table 2, physical properties of the polyester resins A to G and resins prepared by combining them are shown. The resins are represented by resin numbers (1) to (10). Among these, resin numbers used in the examples and the comparative examples are as shown below.

Resin number (3): Comparative Examples 1, 5, 10
Resin number (4): Examples 4, 8, 12, 18, 22
Resin number (5): Comparative Examples 2, 6, 11
Resin number (6): Comparative Examples 3, 7, 12
Resin number (7): Comparative Examples 4, 8, 13
Resin number (8): Examples 1, 5, 15, 19
Resin number (9): Examples 2, 6, 13, 14, 16, 20
Resin number (10): Examples 3, 7, 9, 10, 11, 17, 21, Comparative Example 9

TABLE 1

| | Composition of polyester resin used (charging amount) | | | | | | | |
|---|---|---|---|---|---|---|---|---|
| Monomer | A | B | C | D | E | F | Monomer | G |
| EG | 124 (2.00) | 124 (2.00) | 24.1 (0.39) | 93 (1.50) | 4.34 (0.07) | 93 (1.50) | ST | 265.2 (2.55) |
| CHDM | 72.1 (0.50) | 72.1 (0.50) | | | | | n-BAC | 57.6 (0.45) |
| BPA-EO | | | 211.3 (0.65) | 211.3 (0.65) | 113.5 (0.35) | | | |
| BPA-PO | | | | | 260.6 (0.75) | 243.6 (0.70) | | |
| TPA | 67.9 (0.35) | 77.6 (0.40) | 116.4 (0.60) | 116.4 (0.60) | 145.5 (0.75) | 116.4 (0.60) | | |
| IPA | 87.3 (0.45) | 87.3 (0.45) | 77.6 (0.40) | 77.6 (0.40) | | 77.6 (0.40) | | |
| CHDA | 40.0 (0.20) | 30.0 (0.15) | | | | | | |
| DSA | | | | | 46.8 (0.15) | | | |
| TMA | | | | | 25.2 (0.10) | | | |
| Catalyst | Ti 1.5 | Ti 1.5 | Sn 2.0 | Ti 1.5 | Sn 3.0 | Ti 1.5 | | |

Numerical values are by weight. Numerical values in bracket represent mol number.

Abbreviation: EG: ethylene glycol, CHDM: cyclohexane dimethanol, BPA-EO: bisphenol A ethylene oxide 2.2. mol adduct, BAP-PO: bisphenol A propylene oxide 2.0 mol adduct, TPA: dimethyl terephthalate, IPA: dimethyl isophthalate, CHDA: dimethyl cyclohexanedicarboxylate, DSA: dimethyl dodecenylsuccinate, TMA: trimethyl trimellitate, catalyst Ti: titanium teetrabutoxide, catalyst Sn:

dibutyltin oxide, ST: styrene monomer, n-Bac: normal butyl acrylate monomer

TABLE 2

Physical properties of polyester resins used in example and comparative example

| Resin No. | Resin used 1 | Resin used 2 | Mw (× 1000) | Mn (× 1000) | Tg (° C.) | Temperature at which tan δ is minimum (° C.) | Tan δ min | G' when tan δ is minimum (× $10^5$) (Pa) | Temperature when $10^4$ Pa.s (° C.) | tan δ when $10^4$ Pa.s |
|---|---|---|---|---|---|---|---|---|---|---|
| (1) | A (100) | — | 35.0 | 15.5 | 60.5 | 77.0 | 0.47 | 8.9 | 136.0 | 8.3 |
| (2) | B (100) | — | 14.3 | 7.2 | 56.2 | 71.0 | 0.97 | 6.6 | 104.5 | 17.6 |
| (3) | C (100) | — | 9.5 | 4.6 | 65.1 | 76.5 | 1.49 | 4.5 | 97.5 | 20.9 |
| (4) | D (100) | — | 17.3 | 7.3 | 67.3 | 85.0 | 0.91 | 6.5 | 113.0 | 10.2 |
| (5) | E (100) | — | 88.9 | 5.1 | 69.9 | 91.0 | 0.91 | 3.8 | 127.0 | 1.6 |
| (6) | F (100) | — | 17.4 | 6.6 | 68.2 | 85.5 | 1.13 | 4.5 | 111.0 | 12.7 |
| (7) | G (100) | — | 63.3 | 26.6 | 65 | 90.0 | 0.9 | 1.5 | 122.0 | 3.4 |
| (8) | A (30) | B (70) | 18.5 | 8.3 | 57.8 | 73.0 | 0.83 | 6.0 | 112.0 | 9.8 |
| (9) | A (50) | B (50) | 23.4 | 9.6 | 58.6 | 73.5 | 0.72 | 6.2 | 117.0 | 7.9 |
| (10) | A (50) | C (50) | 18.1 | 6.7 | 65.2 | 77.0 | 0.89 | 6.6 | 111.0 | 9.6 |

Example 1

Preparation of Toner 1

28.8 parts by weight of the polyester resin A, 67.2 parts by weight of the polyester resin B and 4 parts by weight of a cyan pigment (Cyanine Blue 4933M: manufactured by Dainichi Seika K.K.) were melted and kneaded in a Banbury mixer type kneading machine according to composition ratio shown in Table 3. The kneaded material was molded by a spreading roll into a plate having a thickness of about 1 cm, then, coarsely ground by a Fitsu mill type pulverizing machine into about several mm, then, finely ground by an IDS type pulverizing machine, and classified by an Elbow type classifying machine, sequentially, to obtain a toner.

To the resulting toner was added 3% by weight of a hydrophobic silica powder (R972: manufactured by Nippon Aerosil Co.,Ltd.) to prepare the toner.

According to the same manner, a magenta toner, black toner and yellow toner were prepared using as a coloring agent a magenta pigment (Seikafast Carmine 1476T-7: manufactured by Dainichi Seika K.K.), yellow pigment (Seikafast Yellow 2400: manufactured by Dainichi Seika K.K.) and carbon black (Carbon Black #25: manufactured by Mitsubishi Chemical Co., Ltd.), respectively, instead of the cyan pigment (Cyanine Blue 4933M: manufactured by Dainichi Seika K.K.), and a four-component full color toner was prepared. The resulting toner was named Toner A1. The grit distribution of the toner was measured by Colter Counter TA-II type (manufactured by Colter Co.).

Examples 2 to 4

Toners A2 to A4 were prepared in the same manner as in Example 1 according to composition ratios shown in Table 3.

Example 5

28.5 parts by weight of the polyester resin A, 66.5 parts by weight of the polyester resin B and 4 parts by weight of a cyan pigment (Cyanine Blue 4933M: manufactured by Dainichi Seika K.K.) were melted and kneaded in a Banbury mixer type kneading machine according to composition ratio shown in Table 3, and 7 minutes after initiation of the kneading, 1 part by weight of wax was added and further melted and kneaded for 8 minutes. The kneaded material was molded by a spreading roll into a plate having a thickness of about 1 cm, then, coarsely ground by a Fitsu mill type pulverizing machine into about several mm, then, finely ground by an IDS type pulverizing machine, and classified by an Elbow type classifying machine, sequentially, to obtain Toner A5.

To the resulting toner was added 3% by weight of a hydrophobic silica powder (R972: manufactured by Nippon Aerosil K.K.) to prepare the toner.

In the same manner, a magenta toner, black toner and yellow toner were prepared using as a coloring agent a magenta pigment (Seika Fast Carmin 1476T-7: manufactured by Dainichi Seika K.K.), yellow pigment (Seika Fast Yellow 2400: manufactured by Dainichi Seika K.K.) and carbon black (Carbon Black #25: manufactured by Mitsubishi Chemical Co., Ltd.), respectively, instead of the cyan pigment (Cyanine Blue 4933M: manufactured by Dainichi Seika K.K.), and a four-component full color toner was prepared.

Examples 6 to 9

Toners A6 to A9 were prepared in the same manner as in Example 5 according to composition ratios shown in Table 3.

Example 10

46.5 parts by weight of the polyester resin A, 46.5 parts by weight of the polyester resin C, 3.0 parts by weight of the styrene resin H and 4 parts by weight of a cyan pigment (Cyanine Blue 4933M: manufactured by Dainichi Seika K.K.) were melted and kneaded in a Banbury mixer type kneading machine according to composition ratio shown in Table 3. The kneaded material was molded by a spreading roll into a plate having a thickness of about 1 cm, then, coarsely ground by a Fitsu mill type pulverizing machine into about several mm, then, finely ground by an IDS type pulverizing machine, and classified by an Elbow type classifying machine, sequentially, to obtain Toner A10.

To the resulting toner was added 3% by weight of a hydrophobic silica powder (R972: manufactured by Nippon Aerosil K.K.) to prepare the toner.

In the same manner, a magenta toner, black toner and yellow toner were prepared using as a coloring agent a magenta pigment (Seika Fast Carmin 1476T-7: manufactured by Dainichi Seika K.K.), yellow pigment (Seika Fast Yellow 2400: manufactured by Dainichi Seika K.K.) and carbon black (Carbon Black #25: manufactured by Mitsubishi Chemical Co., Ltd.), respectively, instead of the cyan pigment (Cyanine Blue 4933M: manufactured by Dainichi Seika K.K.), and a four-component full color toner was prepared. The grit distribution of the toner was measured by Colter Counter TA-II type (manufactured by Colter Co.).

Example 11

45.5 parts by weight of the polyester resin A, 45.5 parts by weight of the polyester resin C, 4.0 parts by weight of the styrene-acryl copolymer H and 4 parts by weight of a cyan pigment (Cyanine Blue 4933M: manufactured by Dainichi Seika K.K.) were melted and kneaded in a Banbury mixer type kneading machine according to composition ratio shown in Table 3, and 7 minutes after initiation of the kneading, 1 part by weight of wax was added and further melted and kneaded for 8minutes. The kneaded material was molded by a spreading roll into a plate having a thickness of about 1 cm, then, coarsely ground by a Fitsu mill type pulverizing machine into about several mm, then, finely ground by an IDS type pulverizing machine, and classified by an Elbow type classifying machine, sequentially, to obtain Toner A11.

To the resulting toner was added 3% by weight of a hydrophobic silica powder (R972: manufactured by Nippon Aerosil K.K.) to prepare the toner.

In the same manner, a magenta toner, black toner and yellow toner were prepared using as a coloring agent a magenta pigment (Seika Fast Carmin 1476T-7: manufactured by Dainichi Seika K.K.), yellow pigment (Seika Fast Yellow 2400: manufactured by Dainichi Seika K.K.) and carbon black (Carbon Black #25: manufactured by Mitsubishi Chemical Co., Ltd.), respectively, instead of the cyan pigment (Cyanine Blue 4933M: manufactured by Dainichi Seika K.K.), and a four-component full color toner was prepared.

Examples 12 to 14

Toners A12 to A14 were prepared in the same manner as in Example 11 according to composition ratios shown in Table 3.

Comparative Examples 1 to 4

Toners B1 to B4 were prepared in the same manner as in Example 1 according to composition ratios shown in Table 4.

Comparative Examples 5 to 8

Toners B5 to B8 were prepared in the same manner as in Example 5 according to composition ratios shown in Table 4.

Comparative Examples 9

Toner B9 were prepared in the same manner as in Example 11 according to composition ratio shown in Table 4.

Pigment concentrations in Tables 3 and 4 below are all 4% by weight, and wax in tables is purified carnauba wax manufactured by Noda Wax K.K.

TABLE 3

Composition of toner for fixing test

| | Toner name | Polyester resin used 1 | Polyester resin used 2 | Vinyl resin used | Wax | Particle size (μ) | Reference resin number (table 2) |
|---|---|---|---|---|---|---|---|
| Example 1 | Toner A1 | A (28.8) | B (67.2) | — | — | 8.8 | (8) |
| Example 2 | Toner A2 | A (48.0) | B (48.0) | — | — | 9.8 | (9) |
| Example 3 | Toner A3 | A (48.0) | C (48.0) | — | — | 8.0 | (10) |
| Example 4 | Toner A4 | D (96.0) | — | — | — | 10.3 | (4) |
| Example 5 | Toner A5 | A (28.5) | B (66.5) | — | (1.0) | 8.9 | (8) |
| Example 6 | Toner A6 | A (47.5) | B (47.5) | — | (1.0) | 10.1 | (9) |
| Example 7 | Toner A7 | A (47.5) | C (47.5) | — | (1.0) | 8.2 | (10) |
| Example 8 | Toner A8 | D (95.5) | | — | (1.0) | 10.5 | (4) |
| Example 9 | Toner A9 | A (47.75) | C (47.75) | — | (0.5) | 8.0 | (10) |
| Example 10 | Toner A10 | A (46.5) | C (46.5) | H (3.0) | — | 7.3 | (10) |
| Example 11 | Toner A11 | A (45.5) | C (45.5) | K (4.0) | (1.0) | 7.6 | (10) |
| Example 12 | Toner A12 | D (88.0) | — | K (7.0) | (1.0) | 7.5 | (4) |
| Example 13 | Toner A13 | A (41.0) | B (41.0) | K (11.0) | (3.0) | 7.3 | (9) |
| Example 14 | Toner A14 | A (43.5) | B (43.5) | L (8.0) | (1.0) | 9.5 | (9) |

Pigment concentrations are all 4% by weight. Wax is purified carnauba wax (manufactured by Noda Wax K.K.).

TABLE 4

Composition of toner for fixing test

| | Toner name | Polyester resin used 1 | Polyester resin used 2 | Vinyl resin used | Wax | Particle size (μ) | Reference resin number (table 2) |
|---|---|---|---|---|---|---|---|
| Comparative example 1 | Toner B1 | C (96.0) | — | — | — | 7.6 | (3) |
| Comparative example 2 | Toner B2 | E (96.0) | — | — | — | 7.9 | (5) |
| Comparative example 3 | Toner B3 | F (96.0) | — | — | — | 8.8 | (6) |

TABLE 4-continued

Composition of toner for fixing test

| | Toner name | Polyester resin used 1 | Polyester resin used 2 | Vinyl resin used | Wax | Particle size (μ) | Reference resin number (table 2) |
|---|---|---|---|---|---|---|---|
| Comparative example 4 | Toner B4 | G (96.0) | — | — | — | 7.5 | (7) |
| Comparative example 5 | Toner B5 | C (93.0) | — | — | (3.0) | 7.6 | (3) |
| Comparative example 6 | Toner B6 | E (93.0) | — | — | (3.0) | 7.9 | (5) |
| Comparative example 7 | Toner B7 | F (93.0) | — | — | (3.0) | 8.9 | (6) |
| Comparative example 8 | Toner B8 | G (93.0) | — | — | (3.0) | 7.5 | (7) |
| Comparative example 9 | Toner B9 | A (37.0) | C (37.0) | H (21.0) | (1.0) | 6.8 | (10) |

Pigment concentrations are all 4% by weight. Wax is purified carnauba wax (manufactured by Noda Wax K.K.).

Preparation of developer 7 parts by weight of each toner obtained in the examples and the comparative examples, and 93 parts by weight of a carrier were mixed to obtain electorophotographic developers. The carrier is a resin-coated type carrier and obtained by coating on a ferrite core a mixture of an amino group-containing vinyl polymer and a fluoroalkyl group-containing vinyl polymer.

Summary of image output apparatus

Figure 4:
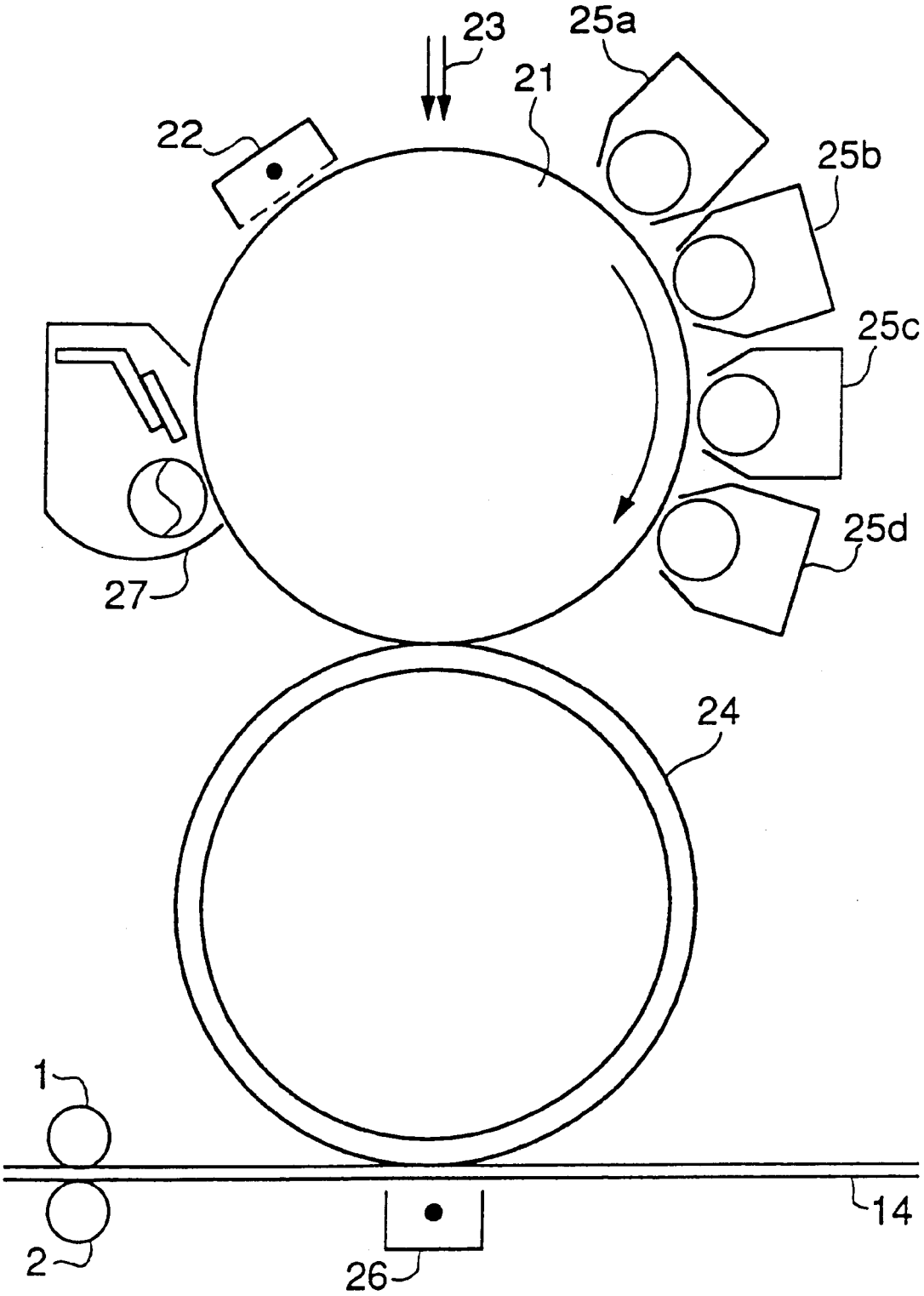
FIG. 4 is a schematic structural view showing an example of an image output apparatus for illustrating the image forming method of the present invention.

As the image output apparatus, an apparatus obtained by modifying A Color 635 (manufactured by Fuji Xerox K.K.) was used. The image output apparatus is summarized in FIG. 4. This image output apparatus is a full-color image output apparatus for general use equipped with a photosensitive material 21, a charging apparatus 22, an exposing apparatus 23, an intermediate transfer material 24, four-color developers 25*a*, 25*b*, 25*c* and 25*d*, a transfer charging apparatus 26 and a cleaner 27.

As specific test conditions, an organic photosensitive material (84 mm ϕ) was used as the photosensitive material 21, LE400 dpi was used as ROS, process speed was 160 mm/sec, latent potential was: rear part=−550V; image part=−150V, a developing roll (common to the first to fourth developers) was fixed by magnet, sleeve rotation, magnet flux density=500G (on sleeve), sleeve diameter=25 mm ϕ, sleeve rotation speed=300 mm/sec, and distance between the photosensitive material 21 and the developing roll (common to the first to fourth developers) was 0.5 mm, distance between a developer layer thickness regulating member and the developing roll (common to the first to fourth developers) was 0.5 mm, developing bias (common to the first to fourth developers) was: DC component=−500V; AC component=1.5 kVP-P (8 kHz), and transfer method is corotron transfer method (wire diameter=85 μm), and a non-fixed image was output.

Production of non-fixed image

Non-fixed images having a toner amount of 1.0 mg/cm$^2$ and 2.5 mg/cm$^2$ were separately made on end parts of color paper (J paper) manufactured by Fuji Zerox K.K. as toner solid images having a size of 50 mm×50 mm, using the above-described image output apparatus.

Evaluation of fixing property of toner

A fixing apparatus was used comprising a heat roll comprising a metal core coated with a silicon rubber layer having a thickness of 2 mm carrying thereon a PFA resin layer of 25 μm, the outer diameter thereof being 50 mm, and a pressure roll comprising a metal core coated with a silicon rubber layer having a thickness of 1 mm carrying thereon a PFA resin layer of 25 μm, the outer diameter thereof being 50 mm, and operation conditions contained a nip width of 6 mm, and a fixing pressure of 6 kgf/cm$^2$.

For coating silicone oil on the fixing apparatus, a silicone oil impregnated roll was installed to the heat roll, and the amount coated was controlled by a blade, and the amount coated was 0.1 mg ($1.7\times10^{-4}$ mg/cm$^2$) per one piece of A4 paper. For measurement of the amount coated of silicone oil, white paper was passed through the fixing apparatus, and the white paper carrying adhered oil was subjected to a Soxhlet extracting machine and the oil was extracted using hexane as a solvent, and the amount of the oil was quantified by an atomic absorption analyzing apparatus.

This fixing apparatus was used, and non-fixed images of the toners were fixed while appropriately changing the temperature of the fixing apparatus, and fixing properties of toners were evaluated by image gloss after fixing, temperature at which hot offset occurs, and fixing latitude which is defined as a temperature range from a temperature at which gloss exceeds 40 to a temperature at which hot offset occurs.

Image gross after fixing was measured using Gloss Meter GM-26D (manufactured by Murakami Color Research Laboratory K.K.) under condition that the incident angle into the sample was 75. Regarding hot offset, white paper was passed through directly after non-fixed image was passed through the fixing apparatus, and if the toner adhered on the white paper was observed visually, it was judged as occurrence of hot offset.

The results are shown in Tables 5 and 6 below. "No releasing" in the column of "Releasing failure occurrence temperature" in Tables 5 and 6, means winding condition onto the fixing apparatus.

TABLE 5

| | | Fixing test result | | | | | |
|---|---|---|---|---|---|---|---|
| | | Amount of toner 1.0 mg/cm$^2$ | | | Amount of toner 2.5 mg/cm$^2$ | | |
| | | Releasing failure occurrence temperature | Maximum gloss obtained | Latitude | Releasing failure occurrence temperature | Maximum gloss obtained | Latitude |
| Example 1 | Toner A1 | 195 | 88 | 50 | 175 | 83 | 30 |
| Example 2 | Toner A2 | 200 | 86 | 55 | 185 | 82 | 40 |
| Example 3 | Toner A3 | 190 | 88 | 40 | 180 | 78 | 30 |
| Example 4 | Toner A4 | 190 | 83 | 40 | 165 | 71 | 15 |
| Example 5 | Toner A5 | 220 or more | 85 | 70 or more | 195 | 95 | 50 |
| Example 6 | Toner A6 | 220 or more | 86 | 70 or more | 200 | 96 | 55 |
| Example 7 | Toner A7 | 220 or more | 84 | 70 or more | 195 | 95 | 45 |
| Example 8 | Toner A8 | 220 or more | 85 | 70 or more | 190 | 93 | 40 |
| Example 9 | Toner A9 | 220 or more | 83 | 70 or more | 190 | 92 | 40 |
| Example 10 | Toner A10 | 185 | 86 | 35 | 175 | 92 | 25 |
| Example 11 | Toner A11 | 210 | 88 | 60 | 195 | 96 | 45 |
| Example 12 | Toner A12 | 205 | 87 | 55 | 185 | 90 | 35 |
| Example 13 | Toner A13 | 210 | 83 | 60 | 195 | 91 | 40 |
| Example 14 | Toner A14 | 200 | 83 | 50 | 185 | 80 | 35 |

TABLE 6

| | | Fixing test result | | | | | |
|---|---|---|---|---|---|---|---|
| | | Amount of toner 1.0 mg/cm$^2$ | | | Amount of toner 2.5 mg/cm$^2$ | | |
| | | Releasing failure occurrence temperature | Maximum gloss obtained | Latitude | Releasing failure occurrence temperature | Maximum gloss obtained | Latitude |
| Comparative example 1 | Toner B1 | No releasing | — | None | No releasing | — | None |
| Comparative example 2 | Toner B2 | No releasing | — | None | No releasing | — | None |
| Comparative example 3 | Toner B3 | 165 | 77 | 20 | No releasing | — | None |
| Comparative example 4 | Toner B4 | No releasing | — | None | No releasing | — | None |
| Comparative example 5 | Toner B5 | 180 | 78 | 35 | No releasing | — | None |
| Comparative example 6 | Toner B6 | 175 | 78 | 35 | No releasing | — | None |
| Comparative example 7 | Toner B7 | 180 | 54 | 20 | No releasing | — | None |
| Comparative example 8 | Toner B8 | No releasing | — | None | No releasing | — | None |
| Comparative example 9 | Toner B9 | 190 | 83 | 45 | No releasing | — | None |

No releasing means winding onto the fixing apparatus.

Evaluation result of toner fixing property

Evaluation results of fixing properties of toners are as shown in Tables 5 and 6.

In the toners obtained in Examples 1 to 4, the minimum value of tan δ (hereinafter, sometimes abbreviated as tan δ(min)) is less than 1.2, and entangling density of binder molecular chains is high. Therefore, the influence of elastic components in the viscoelasticity of a binder is significant, and the toner behaves as an elastomer due to strain applied on the toner in releasing. Consequently, releasing can be carried out satisfactorily not only when the amount of the image toner is small but also when the amount of the image toner is large, namely, when the toner layer has a large thickness.

Latitude was further enlarged when a small amount of wax was included in Examples 5 to 9. The fixing latitude is preferably 15° C. or more, more preferably 25° C. or more, and the results of the examples were suitable for practical use.

On the other hand, the toner of Comparative Example 1 was a binder which is generally used conventionally as a toner for a color copying machine, however, it has tan δ(min) value of 1.2 or more, therefore, the influence of viscous components in the viscoelastic properties of the binder is significant, and the toner cannot behave as an elastomer even with strain applied on the toner in releasing. Consequently, the toner could not be released even when wax was included (Comparative Example 5), and wound on the fixing roll.

Regarding the toner of Comparative Example 3, though the molecular weight thereof is approximately the same as that of the toner in Example 4, the tan δ(min) value was over 1.2 due to difference of a monomer constituting the binder.

Therefore, this toner could not be released because of the same reason as for the toner in Comparative Example 1. Also the toner of Comparative Example 7 could not released when the amount of the image toner is large though it could be released when the amount of the image toner is small, because of the same reason.

The toner of Comparative Example 2 has a value of tan δ(min) smaller than 1.2, however, this is not because of entangling of binder molecules but because of the cross-linked structure. Namely, since it shows viscous behavior over the value of tan δ (min) in releasing due to a very wide composition distribution in the binder, it could not released when the amount of the image toner is large. Further, due to its cross-linked component, the tan δ value at a temperature wherein $G''=1\times10^4$ Pa was as small as 1.6, and gloss did not increase. Also the toner containing wax of Comparative Example 6 could not be released when the amount of the image toner is large though it could be released when the amount of the image toner is small, because of the same reason.

The toner of Comparative Example 4 also has a tan δ value lower than 1, however, G' is as small as 1.5 at a temperature corresponding to tan δ(min). Therefore, if the influence of viscous components in the viscoelastic properties of the binder is large, the absolute value is small. Consequently, the elastic repulsive force was weak and releasing was impossible. Also the toner of Comparative Example 8 which contains wax could not released, because of the same reason.

In the toners obtained in Examples 10 to 14, the size of the ground particles could be reduced as compared with a toner containing no vinyl-based resin.

Further, in the toner of Comparative Example 9 containing a large amount of the vinyl-based resin, pulverizing properties were improved significantly, however, due to so much reduced content of the polyester resin, viscoelastic properties of the polyester resin could not utilized effectively, and releasing properties decreased significantly.

Examples 15 to 22 and Comparative Examples 10 to 13

Preparation of toner 2

In the same manner as in (Preparation of toner 1), Toners A15 to A22 of examples and Toners B10 to B13 of comparative examples were prepared according to Table 7. Regarding toners overlapped with those in Tables 3, 4 and 5, the toners prepared in (Preparation of toner 1) were used without any treatment.

In Table 7 below, pigment concentrations are all 4% by weight, and wax PE represents tetracontane.

Evaluation of fixing property of toner 2

Fixing properties of the toners in Table 7 were evaluated in the same manner as in (Evaluation of fixing property of toner 1) except that coating of oil onto the fixing apparatus was not conducted at all. The results are shown in Table 8 below. "No releasing" in the column of "Releasing failure occurrence temperature" in Table 8, means winding condition onto the fixing apparatus, like in Table 6.

TABLE 7

Composition of toner for fixing test

| | Toner name | Polyester resin used 1 | Polyester resin used 2 | Vinyl resin used | Wax | Particle size (μ) | Reference resin number (table 2) |
|---|---|---|---|---|---|---|---|
| Example 15 | Toner A15 | A (28.5) | B (66.5) | — | PE (1.0) | 8.9 | (8) |
| Example 16 | Toner A16 | A (47.5) | B (47.5) | — | PE (1.0) | 10.1 | (9) |
| Example 17 | Toner A17 | A (47.5) | C (47.5) | — | PE (1.0) | 8.2 | (10) |
| Example 18 | Toner A18 | D (95.0) | — | — | PE (1.0) | 10.2 | (4) |
| Example 19 | Toner A19 | A (27.9) | B (65.1) | — | PE (3.0) | 9.0 | (8) |
| Example 20 | Toner A20 | A (46.5) | B (46.5) | — | PE (3.0) | 10.2 | (9) |
| Example 21 | Toner A21 | A (46.5) | C (46.5) | — | PE (3.0) | 8.3 | (10) |
| Example 22 | Toner A22 | D (93.0) | — | — | PE (3.0) | 10.6 | (4) |
| Comparative example 10 | Toner B10 | C (93.0) | — | — | PE (3.0) | 7.6 | (3) |
| Comparative example 11 | Toner B11 | F (93.0) | — | — | PE (3.0) | 7.9 | (5) |
| Comparative example 12 | Toner B12 | E (93.0) | — | — | PE (3.0) | 8.8 | (6) |
| Comparative example 13 | Toner B13 | C (93.0) | — | — | PE (3.0) | 7.5 | (7) |

TABLE 8

Fixing test result

| | | Amount of toner 1.0 mg/cm$^2$ | | | Amount of toner 2.5 mg/cm$^2$ | | |
|---|---|---|---|---|---|---|---|
| | | Releasing failure occurrence temperature | Maximum gloss obtained | Latitude | Releasing failure occurrence temperature | Maximum gloss obtained | Latitude |
| Example 15 | Toner A15 | 200 | 85 | 55 | 190 | 83 | 30 |
| Example 16 | Toner A16 | 205 | 86 | 60 | 195 | 82 | 40 |
| Example 17 | Toner A17 | 195 | 84 | 45 | 190 | 78 | 30 |
| Example 18 | Toner A18 | 195 | 85 | 45 | 190 | 71 | 15 |
| Example 19 | Toner A19 | 220 or more | 83 | 70 or more | 195 | 95 | 50 |

TABLE 8-continued

| | | Fixing test result | | | | | |
|---|---|---|---|---|---|---|---|
| | | Amount of toner 1.0 mg/cm$^2$ | | | Amount of toner 2.5 mg/cm$^2$ | | |
| | | Releasing failure occurrence temperature | Maximum gloss obtained | Latitude | Releasing failure occurrence temperature | Maximum gloss obtained | Latitude |
| Example 20 | Toner A20 | 220 or more | 87 | 70 or more | 200 | 96 | 55 |
| Example 21 | Toner A21 | 220 or more | 82 | 70 or more | 200 | 95 | 45 |
| Example 22 | Toner A22 | 220 or more | 84 | 70 or more | 195 | 93 | 40 |
| Comparative example 10 | Toner A10 | 165 | 75 | 35 | No releasing | — | None |
| Comparative example 11 | Toner A11 | 170 | 45 | 10 | No releasing | — | None |
| Comparative example 12 | Toner A12 | 190 | 82 | 40 | No releasing | — | None |
| Comparative example 13 | Toner A13 | No releasing | — | None | No releasing | — | None |

Evaluation results of toner fixing properties 2

Evaluation results of the fixing properties of the toners are shown in Table 8. Toners used in the examples exhibited the same excellent results as in the evaluation results in (Evaluation of fixing properties of toner 1) even when oil for releasing is not used. On the other hand, in toners used in the comparative examples, though offset was not observed particularly when the amount of the image toner was large, like in (Evaluation of fixing property of toner 1), releasing failure was exhibited that the toner wound around the fixing apparatus.

Examples 23

Preparation of toner (1) Preparation of polyester resin 50 parts by weight of the polyester resin A and 50 parts by weight of the polyester resin B were melted and kneaded in a Banbury type kneading machine to obtain a mixed polyester resin AB.

(2) Preparation of pigment dispersion 50 parts by weight of the mixed polyester resin AB and 50 parts by weight of a cyan pigment were dissolved and dispersed into 150 parts by weight of ethyl acetate, and further, to this was added a glass bead and the mixture was charged into a sand mill dispersing machine. The mixture was dispersed for 3 hours in high speed stirring mode while cooling the circumference of the dispersing vessel. Further, a suitable amount of ethyl acetate was added with continuing stirring, to prepare a pigment dispersion having a pigment concentration of 10% by weight.

(3) Preparation of fine particle wax 10 parts by weight of wax which had been previously ground by mortar and the like was dispersed into 90 parts by weight of ethyl acetate, and this was charged into a high pressure emulsifying machine APV GAULIN HOMOGENIZER 15MR type and treated at a pressure of 50 kg/cm$^2$ to obtain a dispersion containing fine particles of the wax. This process was conducted with volatile ethyl acetate suitably added during the process. The resulting fine dispersion was subjected to the same process again. The wax grit in the resulting fine dispersion was measured by a laser diffraction/scattered grit distribution measuring apparatus LA-700 (manufactured by Horiba Seisakusho K.K.) to find it was about 0.9 $\mu$m.

The prepared fine wax dispersion was diluted with ethyl acetate so that the concentration by weight of the wax was 10% by weight.

(4) Preparation of oil phase 87 parts by weight of the mixed polyester resin AB was dissolved in 200 parts by weight of ethyl acetate, and this dissolved solution, 40 parts by weight of a pigment dispersion (resin concentration 10% by weight, pigment concentration 10% by weight) and 50 parts by weight of a dispersion of fine particle wax (wax concentration 10% by weight) were charged into a homomixer (ACE Homogenizer, manufactured by NIHONSEIKI Kaisya Ltd.) and stirred for 2 minutes at 15000 rpm to prepare a uniform oil phase.

(5) Preparation of aqueous phase 1

60 parts by weight of calcium carbonate (average particle size 0.03 $\mu$m) and 40 parts by weight of pure water were stirred for 4 days by a ball mill to prepare an aqueous calcium carbonate solution. The average particle size of this calcium carbonate was measured using the above-described laser diffraction/scattered grit distribution measuring apparatus LA-700 (manufactured by Horiba Seisakusho K.K.) to find it was about 0.08 $\mu$m.

(6) Preparation of aqueous phase 2

2 parts by weight of carboxylmethylcellulose (Serogen BSH; manufactured by Dai-ichi Kougyo Seiyaku K.K.) was dissolved into 98 parts by weight pure water, to prepare an aqueous carboxymethylcellulose solution.

(7) Production method of toner 60 parts by weight of the oil phase (4), 10 parts by weight of the aqueous calcium carbonate solution (5) and 30 parts by weight of the aqueous carboxymethylcellulose solution (6) were charged into a colloid mill (manufactured by Nippon Seiki K.K.), and emulsified for 20 minutes at a gap distance of 1.5 mm and 8000 rpm. Then, the emulsion was charged into a rotary evaporator, and the solvent was removed for 3 hours under reduced pressure of 30 mmHg at room temperature. Then, 12 N of hydrochloric acid was added until pH 2, and calcium carbonate was removed from the surface of the toner. Then, 10N sodium hydroxide was added until pH 10, and further, the mixture was stirred in an ultrasonic washing bath for one hour while being agitated by an agitator. Further, it was subjected to centrifugal sedimentation, and washed by exchanging the supernatant three times, then dried, to obtain a toner having a pigment content of 4% by weight and a wax content of 5%.

To the resulting toner was added 3% by weight of a hydrophobic silica powder (R972: manufactured by Nippon Aerosil K.K.) to control the toner.

Example 24

Toner A24 was prepared in the same manner as in Example 23 except that the polyester resin C was used instead of the polyester resin B.

Example 25

Toner A25 was prepared in the same manner as in Example 24 except that amounts of the mixed polyester resin AC, the pigment dispersion and the dispersion of the fine particle wax were changed to 85 parts by weight, 40 parts by weight and 70 parts by weight, respectively so that the wax content in the toner was 7% by weight in the preparation of the oil phase (4).

Example 26

Toner A26 was prepared in the same manner as in Example 24 except that amounts of the mixed polyester resin AC, the pigment dispersion and the dispersion of the fine particle wax were changed to 82 parts by weight, 40 parts by weight and 100 parts by weight, respectively so that the wax content in the toner was 10% by weight in the preparation of the oil phase (4).

Evaluation of transferring efficiency of toner

For measuring transferring efficiency 1 from a photosensitive material to an intermediate transfer material, a toner image on the photosensitive material was collected by a transparent adhesive tape, and the image was measured by color reflection densitometer. Then, a toner image was made again, this toner image was transferred onto the intermediate transfer material, and collected by the adhesive tape in the same manner, and the concentration of the image was measured.

The transferring efficiency is calculated as described below.

Transferring efficiency 1=(concentration of toner image collected from intermediate transfer material)/(concentration of toner image collected from photosensitive material)

Likewise, the transferring efficiency from the intermediate transfer material to the transfer material is calculated as follows.

Transferring efficiency 2=(concentration of toner image collected from transfer material)/(concentration of toner image collected from intermediate transfer material)

The final transferring efficiency is calculated as follows.

Final transferring efficiency=transferring efficiency 1×transferring efficiency 2

The transferring efficiencies of Toner A20, Toner A21 prepared by a kneading pulverizing method, Toner A23, Toner A24, Toner A25 and Toner A26 prepared by an in-liquid drying method were evaluated according to the formulae described above. Toner compositions are shown in Table 9. PE of wax in Table 9 represents tetracontane.

TABLE 9

Compositions and evaluation of toner for fixing test

| | Toner name | Polyester resin used 1 | Polyester resin used 2 | Transferring efficiency 1 | Transferring efficiency 2 | Amount of toner 2.5 mg/cm$^2$ Releasing failure occurrence temperature | Maximum gloss obtained | Latitude | Reference resin number (Table 2) |
|---|---|---|---|---|---|---|---|---|---|
| Example 20 | Toner A20 | A (46.5) | B (46.5) | 95 | 98 | 200 | 93 | 50 | (9) |
| Example 21 | Toner A21 | A (46.5) | C (46.5) | 97 | 95 | 200 | 93 | 45 | (10) |
| Example 23 | Toner A23 | A (45.5) | B (45.5) | 99 | 99 | 210 | 95 | 55 | (9) |
| Example 24 | Toner A24 | A (45.5) | C (45.5) | 98 | 98 | 210 | 94 | 55 | (10) |
| Example 25 | Toner A25 | A (44.5) | C (44.5) | 98 | 99 | 210 | 92 | 50 | (10) |
| Example 26 | Toner A26 | A (43.0) | C (43.0) | 98 | 98 | 205 | 89 | 45 | (10) |

Evaluation result of transferring efficiency

The evaluation result of transferring efficiencies are as shown in Table 9. The transferring efficiencies of Toner A20 and Toner A21 prepared by a kneading pulverizing method from the photosensitive material 1 to the intermediate transfer material 4 were from 95 to 97%, and the transferring efficiencies from the intermediate transfer material 4 to the transfer material 10 were from 95 to 98%, and overall, transferring efficiencies from 90 to 95% were exhibited. These values did not cause image deterioration, and also the remaining toners did not cause practical problems since they could be removed by a cleaning blade and the like.

On the other hand, the transferring efficiencies of Toner A23, Toner A24, Toner A25 and Toner A26 prepared by an in-liquid drying method from the photosensitive material 1 to the intermediate transfer material 4 were from 98 to 99%, and the transferring efficiencies from the intermediate transfer material 4 to the transfer material 10 were from 98 to 99%, and overall, transferring efficiencies from 96 to 98% were exhibited. The reason for this is that when a toner is prepared by an in-solution drying method, the toner can be made into approximately spherical shape, and consequently, the contact area between the photosensitive material and the transfer material can be reduced. Further, Toner A23, Toner A24, Toner A25 and Toner A26 were evaluated in the same manner as in (Evaluation of fixing property of toner 2) to find they had sufficient fixing latitudes.

The heat blocking properties and OHP penetration properties of the toners shown in Table 9 were evaluated.

Evaluation of heat blocking 5 g of the toners were left in a chamber at 40° C. and 50% RH for 17 hours. After cooling to room temperature, 2 g of the toners were charged onto 45 μm mesh and vibrated under constant conditions. The weight of the toner remaining on the mesh was measured, and weight ratio against charged amount was calculated. This numerical value was recognized as toner heat blocking coefficient. The evaluation results are shown in Table 10.

Evaluation of OHP penetration properties

The toners were fixed in the same manner as in (Evaluation of fixing property of toner) except that an OHP for mochomorome toners (manufactured by Fuji Zerox K.K.) was used as the member of fixing, only cyan toner was used, the amount of the image toner was 0.7 mg/cm$^2$, and the processing speed of the fixing apparatus was 50 mm/sec in (Evaluation of fixing property of toner). Transmittance of the fixed image was measured using a spectrophotometer U-3210 (manufactured by Hitachi Ltd., wavelength 480 nm). Regarding the transmittance, one corresponding to the highest gloss was measured. The results are shown in Table 10.

TABLE 10

Composition and evaluation of toners for fixing test

| | Toner name | Polyester resin used 1 | Polyester resin used 2 | Wax | Particle size (μm) | Heat blocking resistance coefficient (%) | OHP penetration property (%) | Reference resin number (Table 2) |
|---|---|---|---|---|---|---|---|---|
| Example 20 | Toner A20 | A (46.5) | B (46.5) | PE (3.0) | 10.2 | 5.7 | 92 | (9) |
| Example 21 | Toner A21 | A (46.5) | C (46.5) | PE (3.0) | 8.3 | 4.9 | 93 | (10) |
| Example 23 | Toner A23 | A (45.5) | B (45.5) | PE (5.0) | 7.3 | 4.1 | 89 | (9) |
| Example 24 | Toner A24 | A (45.5) | C (45.5) | PE (5.0) | 7.6 | 3.3 | 88 | (10) |
| Example 25 | Toner A25 | A (44.5) | C (44.5) | PE (7.0) | 7.5 | 3.1 | 86 | (10) |
| Example 26 | Toner A26 | A (43.0) | C (43.0) | PE (10.0) | 7.6 | 3.3 | 80 | (10) |

Evaluation result of heat blocking and OHP penetration property

As apparent from Table 10, every toner exhibited extremely excellent heat blocking resistance. When the heat blocking coefficient is 10% or more, problems may sometimes occur in a practical machine, however, the toners of the present invention exhibited practically sufficient values. The toners prepared particularly by the in-solution drying method revealed more excellent values. On the other hand, when the wax content was 10% by weight or more, the OHP penetration properties started to decrease, however, a value of 80% or more has no problem practically and every toner exhibited practically sufficient values.

Evaluation of durability

Continuous image output and fixing were conducted using Toner A3 obtained in Example 3. The same image output apparatus and fixing apparatus as in (Evaluation of fixing property of toner 1) were used, and they were connected for use. Even after continuous image output of 100000 sheets, no image disturbance occurred, and the image was excellent and had few difference from the initial condition. Also in fixing, neither offset nor winding occurred, and no contamination of the fixing roll occurred.

The continuous image output and fixing were conducted in the same manner using the toner A11 obtained in Example 11. Even after continuous image output of 5000 sheets, no image disturbance occurred, and the image was excellent and had few differences from the initial condition. Also in fixing, neither offset nor winding occurred, and no contamination of the fixing roll occurred.

Example 27

A PET film having a thickness of 100 μm on which no receiving layer was formed was used for image evaluation without any treatment. For controlling surface resistance, 1 part by weight of an alkyl phosphate-based surfactant was dissolved in 100 parts by weight of toluene, and the resulting solution was coated on the PET film by using a bar coater and was dried to prepared a transferring film. This transferring film was named film A. Film A had a surface electric resistance of $8.0\times10^{10}$ Ω/cm$^2$.

Example 28

6 parts by weight of the amorphous polyester resin A obtained in the synthesis example of polyester resins, 14 parts by weight of the amorphous polyester resin B obtained in the synthesis example of polyester resins, and 1 part by weight of an alkyl phosphate-based surfactant were dissolved in 100 parts by weight of toluene, and the resulting solution was coated on the PET film by using a bar coater and was dried to prepare a transferring film B. The viscoelastic property of the resin in the image-receiving layer were the same as those of the resin number (8) in Table 2.

Example 29

A transferring film C was prepared in the same manner as in Example 24 except that 10 parts by weight of the amorphous polyester resin A and 10 parts by weight of the amorphous polyester resin B were used as the thermoplastic resin forming the image-receiving layer, and evaluated. The viscoelastic properties of the resin in the image-receiving layer of the film C were the same as those of the resin number (9) in Table 2.

Example 30

A transferring film D was prepared in the same manner as in Example 24 except that 20 parts by weight of the amorphous polyester resin B was used as the thermoplastic resin forming the image-receiving layer, and evaluated. The viscoelastic properties of the resin in the image-receiving layer of the film D were the same as those of the resin number (2) in Table 2.

Example 31

A transferring film E was prepared in the same manner as in Example 24 except that 20 parts by weight of the amorphous polyester resin F was used as the thermoplastic resin forming the image-receiving layer, and evaluated. The viscoelastic properties of the resin in the image-receiving layer of the film E were the same as those of the resin number (6) in Table 2.

Evaluation of offset resistance

Toner A6 obtained in Example 6 was used as a toner, and a solid non-fixed image was formed on each film obtained in Examples 27 to 31 at a toner amount of 2.5 mg/cm$^2$ in the same manner as in the above-described image output method. The film on which the non-fixed image had been formed was fixed at 170° C. using the same fixing apparatus as used in the above-described evaluation of fixing properties of toners at a paper transporting speed of 50 mm/second while coating a releasing agent thereon. Directly after passing through the film, white paper was passed through, and if the toner adhered on the white paper was observed, it was judged that offset occurred. Since the offset of the image-receiving layer of the film could not visually be confirmed since the image-receiving layer was transparent, therefore, the occurrence of deterioration was confirmed such as waving on the surface of the film, peeling of the image-receiving layer and the like after fixing.

Evaluation of light transmission

Toner A6 obtained in Example 6 was used as a toner, and a middle tone non-fixed image having image area ratio of 20% was formed on the film at a toner amount of 0.7 mf/cm$^2$ in the same manner as in the above-described image output method, and the light transmission was evaluated in the same manner as in the above-described evaluation of OHP penetration property.

Evaluation result of offset resistance and light transmission

Evaluation results of the offset resistance and light transmission are shown in Table 11. Since a middle tone image has many edge parts of a toner unlike a solid image, it is usual, in middle tone image parts, that light transmission decreases compared with solid parts. Therefore, in middle tone image parts, it is the least condition that the light transmission is 70% or more, and when it is 80% or more, the same color developing property as that of the original is obtained. On the other hand, when lower than 70%, a projected image reveals a grayish turbid color.

TABLE 11

Evaluation result of offset resistance and light transmittance of transferring film

| | Film | Offset | Transmittance (%) | Reference resin number (Table 2) |
|---|---|---|---|---|
| Example 27 | A | None | 76 | None |
| Example 28 | B | None | 88 | (8) |
| Example 29 | C | None | 88 | (9) |
| Example 30 | D | None | 85 | (2) |
| Example 31 | E | None | 86 | (6) |

In view of the above-described results, as also apparent from Table 11, when the transferring film A obtained in Example 27 on which no image-receiving layer had been formed was used, the projected image in the case of formation of a middle tone image revealed slight turbidity, however, when an image was formed using the film on which the image-receiving layer had been formed using the same material as the toner of the present invention (Examples 28 to 31), the resulting image exhibited excellent light transmittance and also the projected image was clear without turbidity.

Further, in Examples 27 to 31, offset resistance was excellent irrespectively the transferring film providing the toner of the present invention was used. Moreover, also on the image, no image deterioration occurred such as that derived from fixation, charging and the like.

To summarize, the electrophotographic toner of the present invention is suitable also for a color toner, can be fixed at the same amount coated of a releasing agent as that for monochrome toner fixing, provides high image quality and high color developing properties, and is excellent in reliability and durability. Further, an electrophotographic developer using this electrophotographic toner provides a high image quality and high color developing properties.

Moreover, by containing a vinyl-based resin as an auxiliary component within the range wherein the properties of a polyester resin is not lost, productivity can be further improved.

Further, according to the image forming method using this electrophotographic developer of the present invention as a developer, an image can be obtained which has a high image quality and high developing properties, and there is no influence of the releasing agent on a transfer material, therefore, the process ability of a recording material is also excellent.

What is claimed is:

1. An electrophotographic toner comprising a binding resin and a coloring agent, wherein said binding resin includes a resin in which the minimum value of tan δ of said binding resin is between the glass transition temperature (Tg) and a temperature at which the loss modulus (G") is $1\times10^4$ Pa, said minimum value of tan δ is less than 1.2, the storage modulus (G') at a temperature at which tan δ is a minimum is $5\times10^5$ Pa or more, and the value of tan δ is 3.0 or more at a temperature at which $G''=1\times10^4$ Pa.

2. An electrophotographic toner according to claim 1, wherein said resin is a linear polyester resin having no cross-linked structure in the molecule.

3. An electrophotographic toner according to claim 2, wherein said resin is a linear polyester resin which comprises a polyester resin obtained by polymerization according to a transesterification method.

4. An electrophotographic toner according to claim 3, wherein said resin is a linear polyester resin mainly composed of a dicarboxylic acid component selected from the group consisting of terephthalic acid, isophthalic acid, cyclohexanedicarboxylic acid, naphthalene dicarboxylic acid and biphenyldicarboxylic acid, and a diol component selected from the group consisting of ethylene glycol, propylene glycol, cyclohexanedimethanol, and ethylene oxide adducts of bisphenol A.

5. An electrophotographic toner according to claim 1, wherein said resin comprises at least two kinds of resins (A, B), in at least one resin (A), Tg is from 45° C. to 65° C., the minimum value of tan δ of said resin is between Tg and a temperature at which $G''=1\times10^4$ Pa, the minimum value of tan δ is less than 1.0, and the value of tan δ at a temperature at which $G''=1\times10^4$ Pa is 1.0 or more, and in the resin (B) used together, Tg is between Tg+5° C. and Tg+15° C. of the resin (A), and the minimum value of tan δ of said resin is between Tg and a temperature at which $G''=1\times10^4$ Pa.

6. An electrophotographic toner according to claim 1, comprising a binding resin and a coloring agent, wherein said resin is a polyester resin, and the content of said polyester resin based on the total weight of the whole binding resin is 70% by weight or more, and a vinyl-based resin having a weight-average molecular weight (Mw) of 100000 or less is contained in an amount of 20% by weight or less based on the total weight of the whole binding resin.

7. An electrophotographic toner according to claim 6, wherein said polyester resin is a linear polyester resin having no cross-linked structure in the molecule.

8. An electrophotographic toner according to claim 6, wherein said resin comprises at least two kinds of resins (C, D) as said polyester resin, in at least one resin (C), Tg is from 45° C. to 65° C., the minimum value of tan δ of said resin is between Tg and a temperature at which $G''=1\times10^4$ Pa, the minimum value of tan δ is less than 1.0, and the value of tan δ at a temperature at which $G''=1\times10^4$ Pa is 1.0 or more, and in the resin (D) used together, Tg is between Tg+5° C. and Tg+15° C. of the resin (C), and the minimum value of tan δ of said resin is between Tg and a temperature at which $G''=1\times10^4$ Pa.

9. An electrophotographic toner according to claim 1, wherein said electrophotographic toner is produced by using a toner wet production method.

10. An electrophotographic toner according to claim 1, further comprising a releasing agent.

11. An electrophotographic developer comprising an electrophotographic toner, wherein said electrophotographic toner comprises a binding resin and a coloring agent, and as said binding resin, a resin is used in which the minimum value of tan δ of said binding resin is between the glass transition temperature (Tg) and a temperature at which the loss modulus (G") is $1\times10^4$ Pa, said minimum value of tan δ is less than 1.2, the storage modulus (G') at a temperature at which tan δ is a minimum is $5\times10^5$ Pa or more, and the value of tan δ is 3.0 or more at a temperature at which $G''=1\times10^4$ Pa.

12. An electrophotographic developer according to claim 11, wherein said developer is a two-component developer comprising said electrophotographic toner and a carrier.

13. An electrophotographic developer according to claim 12, wherein said carrier is a carrier coated with a resin.

14. An image forming method comprising a process in which a latent image is formed on a latent carrier, a process in which said latent image is developed using an electrophotographic developer, a process in which the developed toner image is transferred onto a transfer material, and a process in which the toner image on the transfer material is heated and pressed, wherein said electrophotographic developer comprises a binding resin and a coloring agent, and an electrophotographic toner is included which includes, as said binding resin, a resin in which the minimum value of tan δ of said binding resin is between the glass transition temperature (Tg) and a temperature at which the loss modulus (G") is $1\times10^4$ Pa, said minimum value of tan δ is less than 1.2, the storage modulus (G') at a temperature at which tan δ is a minimum is $5\times10^5$ Pa or more, and the value of tan δ is 3.0 or more at a temperature at which $G''=1\times10^4$ Pa.

15. An image forming method according to claim 14, wherein said transfer material comprises a substrate having a heat resistance of 100° C. or more and having at least one surface which is an image-receiving layer composed of a thermoplastic resin, and said thermoplastic resin is a resin in which the minimum value of tan δ of said binding resin is between the glass transition temperature (Tg) and a temperature at which the loss modulus (G") is $1\times10^4$ Pa, said minimum value of tan δ is less than 1.2, the storage modulus (G') at a temperature at which tan δ is a minimum is $5\times10^5$ Pa or more, and the value of tan δ is 1.0 or more at a temperature at which $G''=1\times10^4$ Pa.

16. An image forming method according to claim 15, wherein said thermoplastic resin is a linear polyester resin having no cross-linked structure in the molecule.

17. An image forming method according to claim 15, wherein said thermoplastic resin comprises at least two kinds of resins (E, F), in at least one resin (E), Tg is from 45° C. to 65° C., the minimum value of tan δ of said resin is between Tg and a temperature at which $G''=1\times10^4$ Pa, the minimum value of tan δ is less than 1.0, and the value of tan δ at a temperature at which $G''=1\times10^4$ Pa is 1.0 or more, and in the resin (F) used together, Tg is between Tg+5° C. and Tg+15° C. of the resin (E), and the minimum value of tan δ of said resin is between Tg and a temperature at which $G''=1\times10^4$ Pa.

18. An image forming method according to claim 14, wherein said image-receiving layer comprises a releasing agent.

19. An image forming method according to claim 14, wherein said fixing process is conducted using a catalytic type heat fixing apparatus comprising a fluorine resin on the surface of a fixing member.

20. An image forming method according to claim 14, wherein said fixing process is conducted using a heat fixing apparatus without coating oil on the surface of a fixing member or with coating oil at an amount of $8.0\times10^{-4}$ mg/cm$^2$ or less.

* * * * *